US010969192B1

(12) United States Patent
Gallops, Jr. et al.

(10) Patent No.: US 10,969,192 B1
(45) Date of Patent: Apr. 6, 2021

(54) CROSSBOW WITH CROSSING CABLE SYSTEM

(71) Applicant: Barnett Outdoors, LLC, Tarpon Springs, FL (US)

(72) Inventors: Henry M. Gallops, Jr., Gainesville, FL (US); Jason L. Fogg, Lake Point, UT (US)

(73) Assignee: Barnett Outdoors, LLC, Tarpon Springs, FL (US)

( * ) Notice: Subject to any disclaimer, the term of this patent is extended or adjusted under 35 U.S.C. 154(b) by 0 days.

(21) Appl. No.: 16/872,970

(22) Filed: May 12, 2020

Related U.S. Application Data

(60) Provisional application No. 62/847,434, filed on May 14, 2019.

(51) Int. Cl.
*F41B 5/12* (2006.01)

(52) U.S. Cl.
CPC ..... *F41B 5/123* (2013.01)

(58) Field of Classification Search
CPC ..... F41B 5/123; F41B 5/12; F41B 5/105
USPC ..... 124/25
See application file for complete search history.

(56) References Cited

U.S. PATENT DOCUMENTS 4,649,891 A * 3/1987 Bozek ..... F41B 5/123 124/25
4,766,874 A * 8/1988 Nishioka ..... F41B 5/12 124/25
4,879,987 A * 11/1989 Nishioka ..... F41B 5/123 124/25
7,204,242 B2 * 4/2007 Dziekan ..... F41B 5/12 124/25
7,578,289 B2 * 8/2009 Norkus ..... F41B 5/0094 124/25
7,823,572 B2 * 11/2010 Anderson ..... F41B 5/1469 124/25
8,387,603 B2 * 3/2013 Darlington ..... F41B 5/12 124/25.6
8,522,762 B2 * 9/2013 Trpkovski ..... F41B 5/1453 124/25.6
8,651,095 B2 * 2/2014 Islas ..... F41B 5/123 124/25
8,833,349 B2 * 9/2014 Park ..... F41B 5/10 124/25.6

(Continued)

*Primary Examiner* — Alexander R Niconovich
(74) *Attorney, Agent, or Firm* — Jones Walker LLP

(57) ABSTRACT

A crossbow includes a stock, a riser mounted to the stock, left upper and lower mounting brackets attached to the riser, right upper and lower mounting brackets attached to the riser, and cam assemblies respectively mounted to proximal ends of the upper and lower mounting brackets. The crossbow includes first and second limbs respectively attached to distal ends of the left and right upper and lower sides of the riser. A draw string extends between the first and second cam assemblies over the stock and is wrapped around outer surfaces of the cam assemblies. The crossbow includes power cables crossing inside of the stock to form a crossing pattern and traverse a centerline of the stock. The power cables respectively wrap around the cam assemblies through helical take-up journal assemblies extending below each cam assembly, and the power cables respectively connect to opposing limbs at distal ends of the limbs.

32 Claims, 42 Drawing Sheets

(56) References Cited

U.S. PATENT DOCUMENTS

| | | | | |
|---|---|---|---|---|
| 8,997,728 | B2 * | 4/2015 | Popov | F41B 5/1469 124/25.6 |
| 9,255,756 | B1 * | 2/2016 | Wu | F41B 5/123 |
| 9,297,604 | B1 * | 3/2016 | Sidebottom | F41B 5/12 |
| 9,377,267 | B1 * | 6/2016 | Kempf | F41B 5/123 |
| 9,879,937 | B2 * | 1/2018 | McPherson | F41B 5/12 |
| 9,879,938 | B1 * | 1/2018 | Isenhower | F41B 5/123 |
| 10,018,442 | B1 * | 7/2018 | Kempf | F41B 5/123 |
| 10,190,841 | B2 * | 1/2019 | Laurence | F41B 5/123 |
| 10,209,026 | B2 * | 2/2019 | Yehle | F41B 5/066 |
| 10,393,470 | B1 * | 8/2019 | Popov | F41B 5/105 |
| 10,473,418 | B2 * | 11/2019 | Shaffer | F41B 5/123 |
| 10,514,226 | B2 * | 12/2019 | Shaffer | F41B 5/123 |
| 10,520,274 | B2 * | 12/2019 | Bartels | F41B 5/123 |
| 10,533,822 | B1 * | 1/2020 | Popov | F41B 5/123 |
| 10,634,447 | B2 * | 4/2020 | Smith | F41B 5/105 |
| 10,739,104 | B1 * | 8/2020 | Smith | F41B 5/123 |
| 10,767,956 | B2 * | 9/2020 | Popov | F41B 5/123 |
| 2011/0041820 | A1 * | 2/2011 | Stanziale | F41B 5/123 124/25 |
| 2012/0125302 | A1 * | 5/2012 | Stanziale | F41B 5/123 124/25 |
| 2018/0224237 | A1 * | 8/2018 | McPherson | F41B 5/10 |

* cited by examiner

CROSSBOW WITH CROSSING CABLE SYSTEM

CROSS-REFERENCE TO RELATED APPLICATIONS

This application claims the benefit of and priority to U.S. Provisional Patent Application No. 62/847,434, filed on May 14, 2019, which is incorporated in its entirety by reference herein.

FIELD

The disclosure relates to a crossbow with a crossing cable system with power cables crossing the centerline of the stock.

SUMMARY

In earlier crossbows, the timing power cables crossing the centerline of the flight track had to be deflected in a downward direction to pass under the flight track. The offset loads from the cables would tend to deflect the limbs in the direction of the offset, causing "out of plane" travel of the arrow or bolt when the draw string is pulled to the full draw position and released to propel the arrow or bolt.

In some embodiments, the present disclosure addresses these problems by providing for a crossing cable system that is oriented lower on a cable take-up journal attached to the underside of the cam to minimize the offset loads from the timing cables crossing the centerline of the flight track. In some embodiments, the present disclosure uses a smaller cam string profile than previous crossbows via rotating cam assemblies mounted to brackets that are fixed to the riser. In one embodiment, the cams and the limbs are in different vertically spaced horizontal planes, and the power cables are aligned in the same horizontal plane as the limbs. In some embodiments, the cable take-up journal may be attached to the upperside of the cam to minimize the offset loads from the timing cables crossing the centerline of the flight track.

Because the cams may be positioned on (i.e., detachably mounted to) the mounting brackets and therefore not positioned on the limbs, the present disclosure operates without the adverse effects due to the offset loads from the cable system of traditional crossbow systems. The present disclosure provides a crossbow configuration that provides minimal or substantially no deflection of the cables resulting in less friction, while aligning the draw string with the flight line of the crossbow.

In some embodiments, the cam assemblies of the present disclosure can provide for less than 270 degree or greater than 270 degree rotation with the cable system that crosses the centerline of the flight track. The crossing cable system of the present disclosure allows the cam assemblies to work together to provide enhanced cam timing as compared to conventional systems that use an "ipsilateral cable system," which forces each cam to work independently of the other opposing cam.

DETAILED DESCRIPTION OF THE DISCLOSURE

Figure 1:
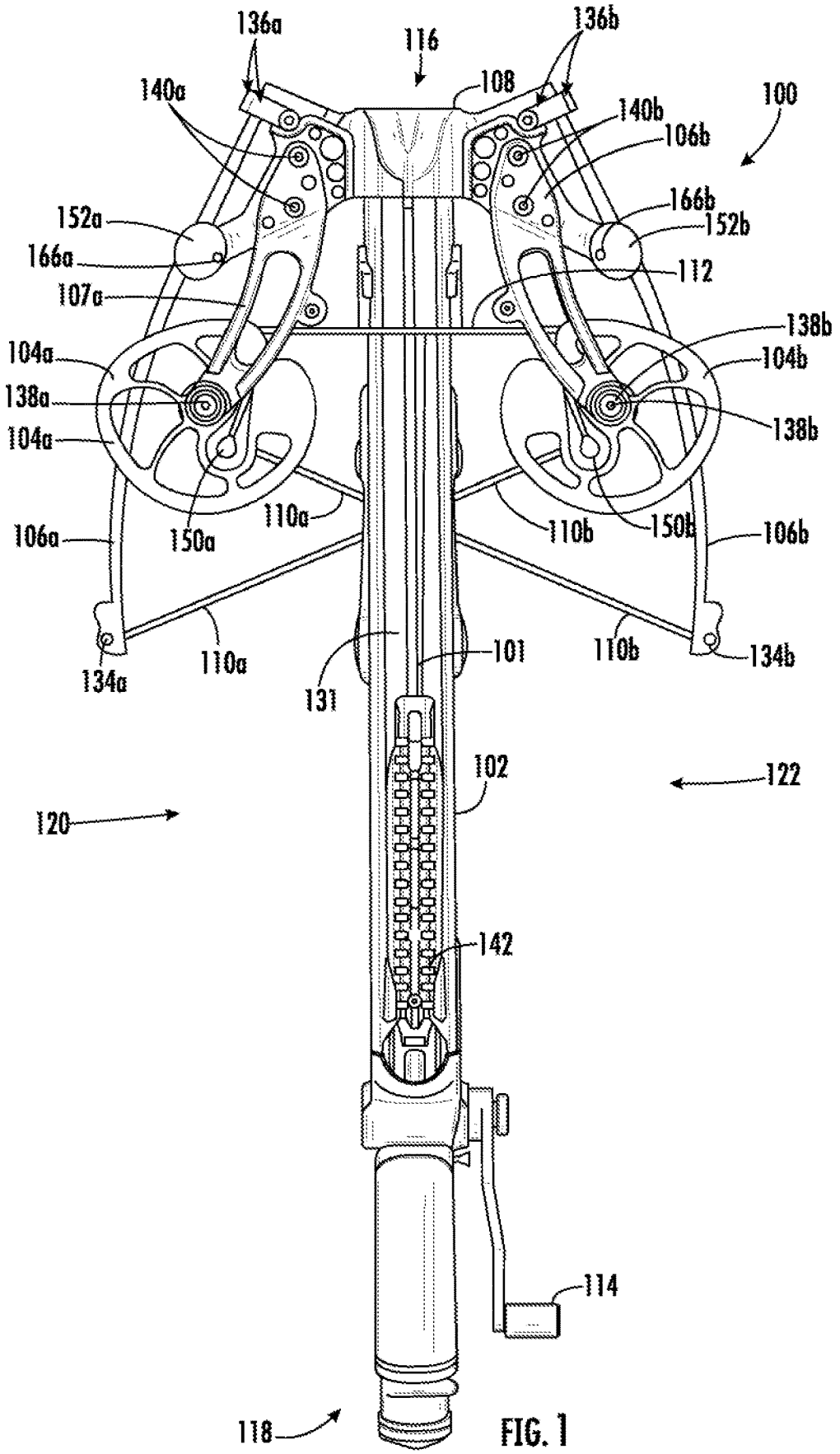
FIG. 1 is a top view of an embodiment of the crossbow with crossing cable system.

With reference to the figures where like elements have been given like numerical designation to facilitate an understanding of the disclosure, and particularly with reference to the embodiment of the disclosure illustrated in FIGS. 1, 2, 3, and 4, which illustrate a crossbow 100 in accordance with disclosed aspects. The crossbow 100 may include stock 102, cam assemblies 104*a* and 104*b*, limbs 106*a* and 106*b*, upper mounting brackets 107*a* and 107*b*, riser 108, power cables 110*a* and 110*b*, draw string 112, cocking assembly 114, lower mounting brackets 124*a* and 124*b*, scope attachment platform 142, safety mechanism 144, trigger 156, trigger guard 158, handle 160, and foregrip 162.

Crossbow 100 may have a stock 102 that may be elongated along a centerline 101 from a distal end 116 to a proximal end 118. A riser 108 may be attached to the distal end 116 of the crossbow. The riser 108 may extend on both sides (left side 120 and right side 122) of the centerline 101 of the stock 102. Limbs 106*a* and 106*b* may respectively attach to left and right sides of riser 108 on the top and at bottom sides of the riser 108, such as at attachment points 136*a* and 136*b* via screws or other fastening means. Limbs 106*a* and 106*b* may be solid limbs or split limbs, as readily understood by skilled artisans.

Limbs 106*a* and 106*b* may have concave bend, be elongated, and extend from the attachment points 136*a*, 136*b* toward the proximal end 118. In some cases, the distal end of the limbs 106 may be spatially closer to the centerline 101 than the proximal end of the limbs 106.

Figure 2:
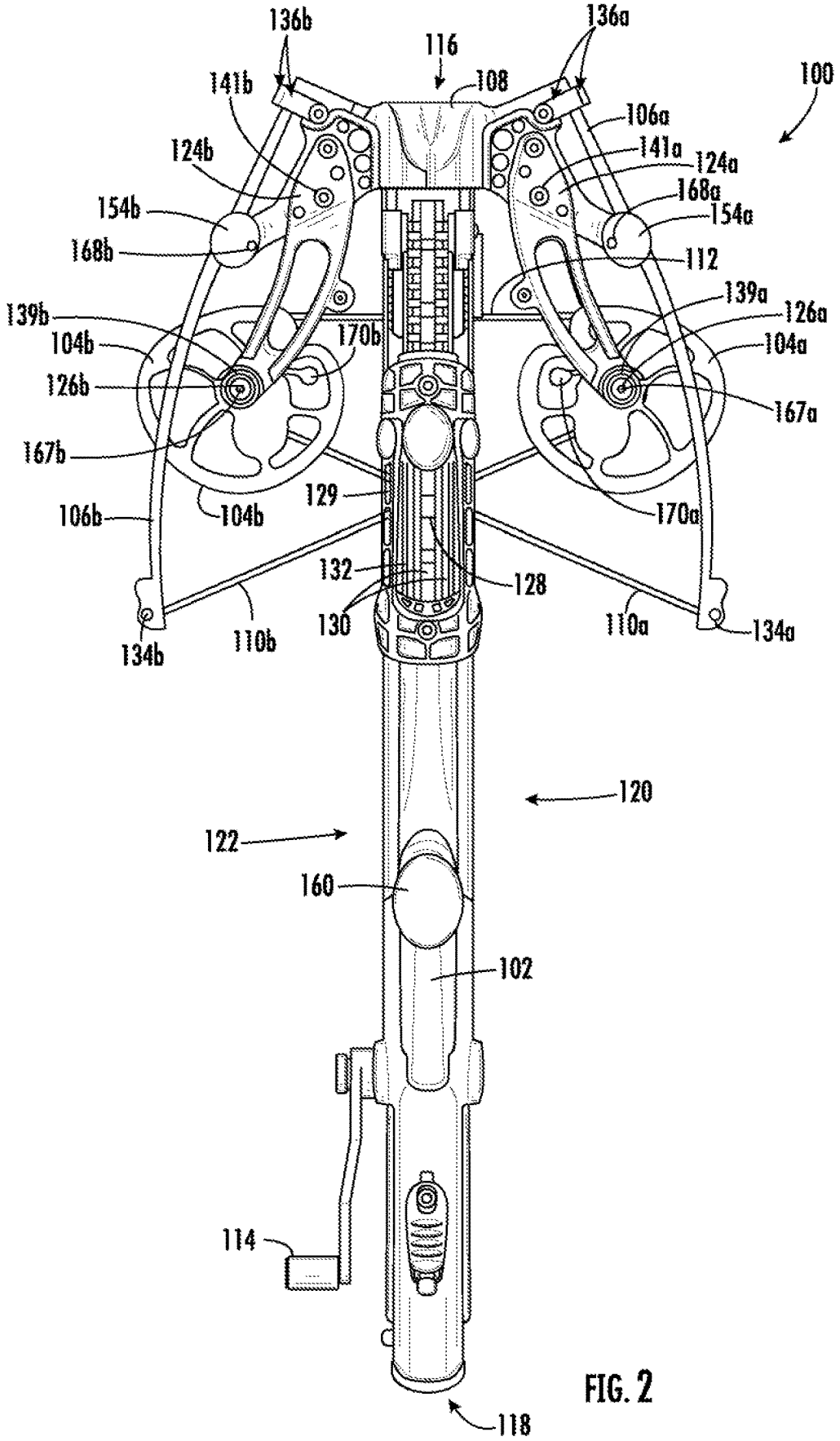
FIG. 2 is a bottom view of the crossbow with crossing cable system as shown in FIG. 1.
Figure 3A:
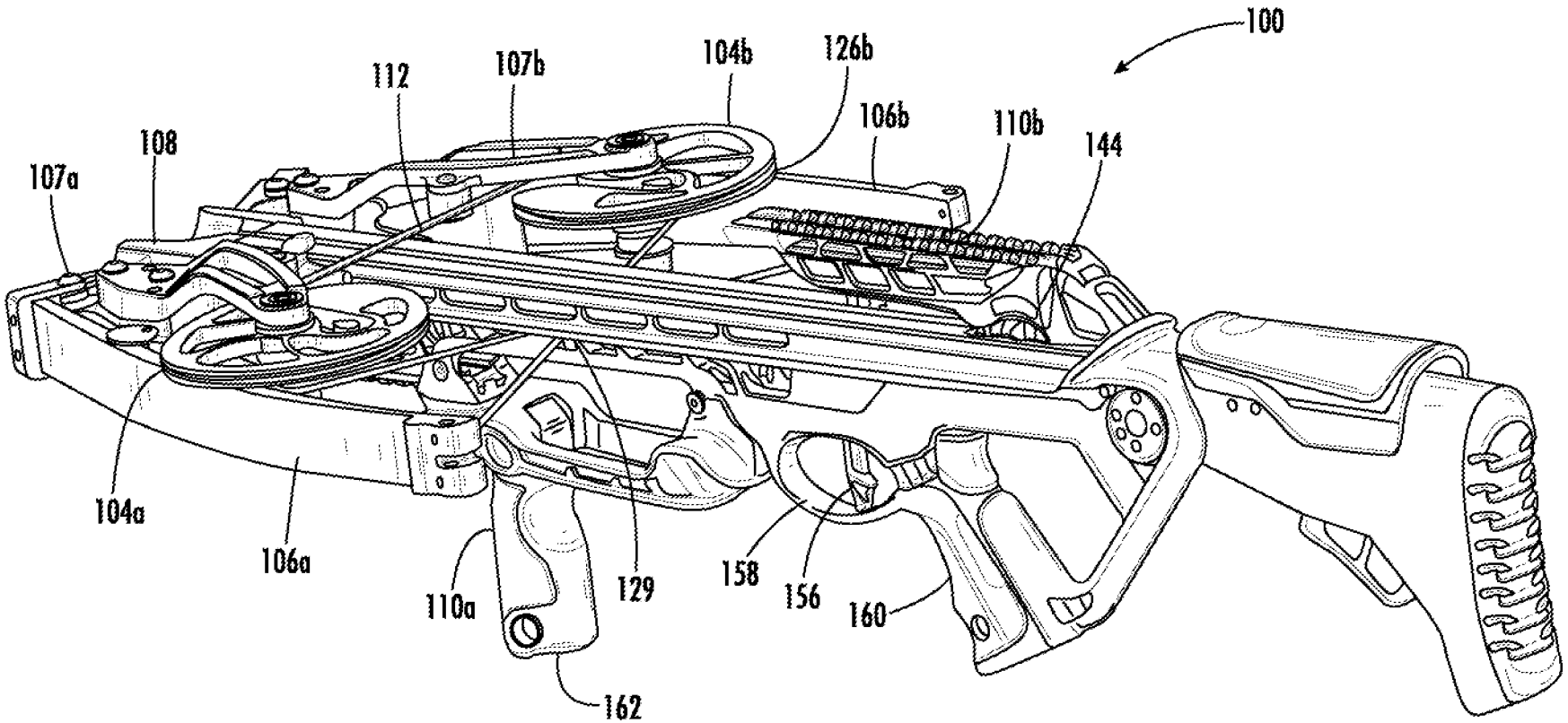
FIG. 3A is perspective view of an embodiment of the crossbow with crossing cable system.
Figure 3B:
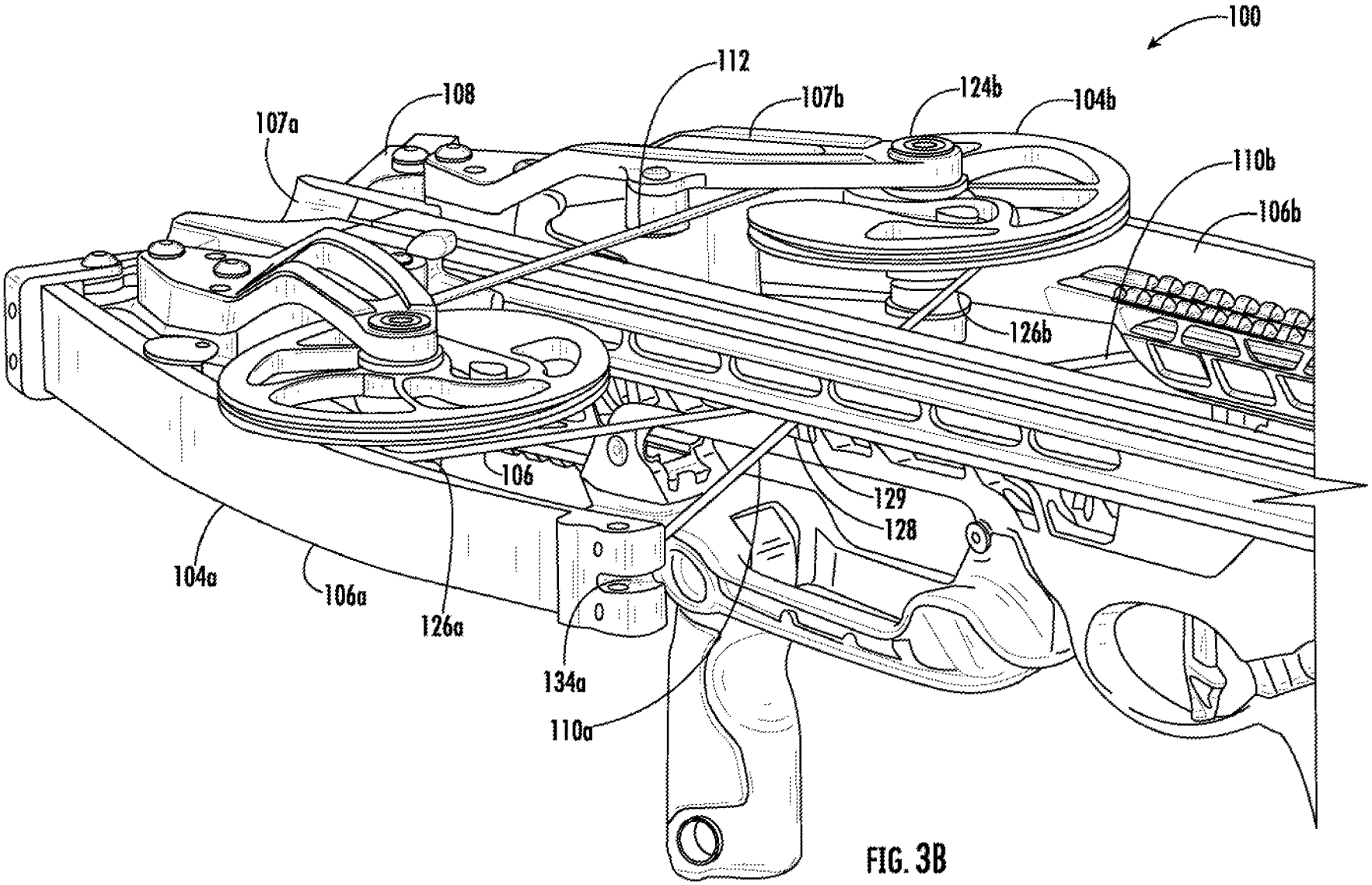
FIG. 3B is a perspective view of the front section of the crossbow with crossing cable system shown in FIG. 3A.
Figure 3C:
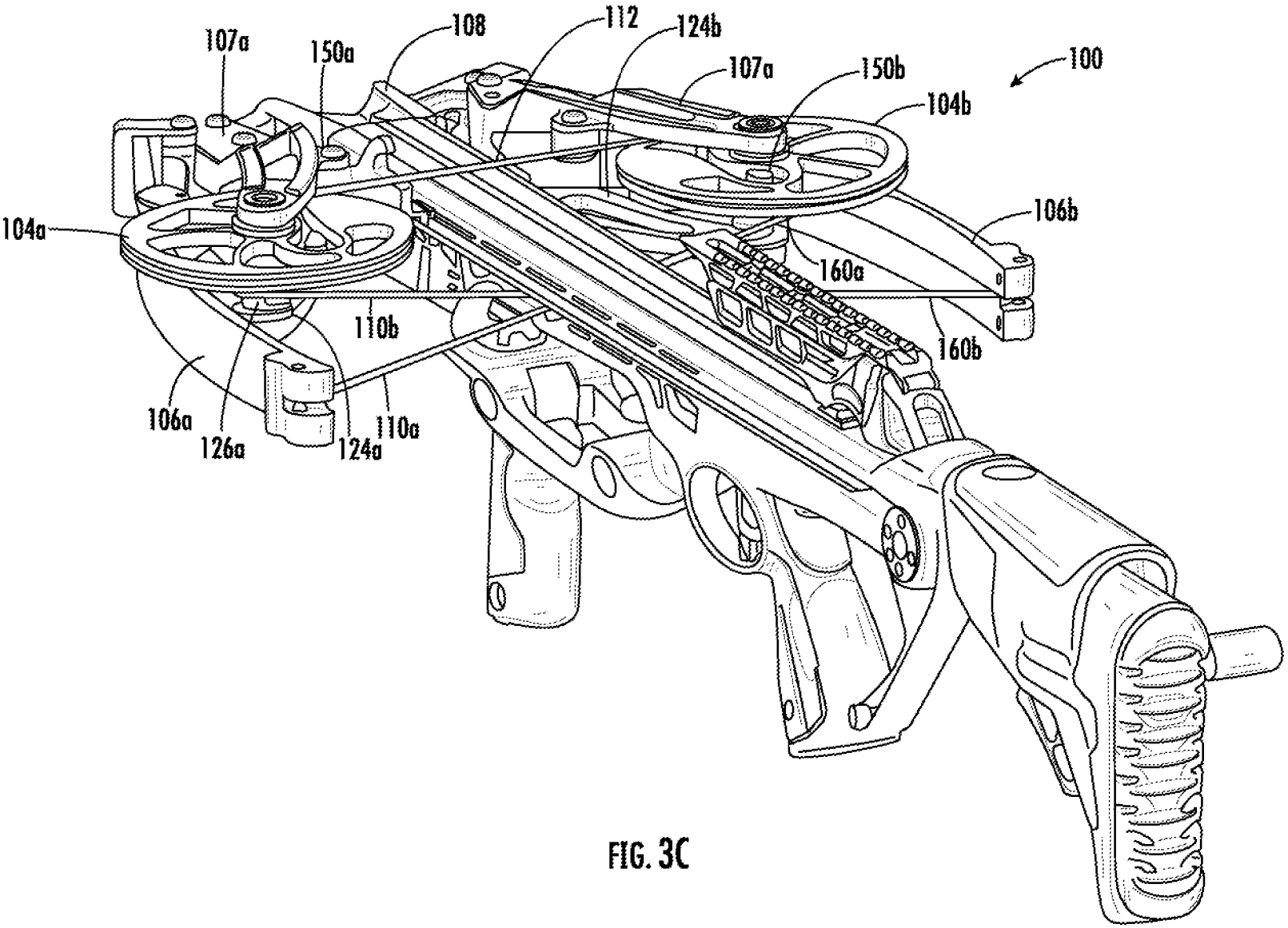
FIG. 3C is a rearward perspective view of the crossbow with crossing cable system as shown in FIG. 3A.

The riser 108 may attach to the limbs 106*a*, 106*b* at junction points 166*a*, 166*b*, 168*a*, 168*b* with upper caps 152*a*, 152*b* and with lower caps 154*a*, 154*b* (FIG. 2). The junction points 166*a*, 166*b*, 168*a*, 168*b* may be positioned toward the upper center point along the length of the limbs 106. The attachment points 136*a* and 136*b* may be located at the distal end of the limbs 106. Caps 152 and 154 may be thin and disc shaped, and may have any shape, such as circular or oval shaped. Caps 152 and 154 may fit inside respective upper arc indentions 706*a*, 706*b* and lower arc indentions 707*a*, 707*b* on the left and right sides of the riser 108 (FIG. 7).

Upper mounting brackets 107*a* and 107*b* may be attached at respective attachment points 140*a*, 140*b* to the riser 108. The upper mounting brackets 107*a*, 107*b* may include a central sloping portion and be elongated and may extend from the attachment points 140*a*, 140*b* toward the proximal end 118, such that the proximal end of the mounting brackets 107*a*, 107*b* may be non-coplanar with a distal end of the brackets 107*a*, 107*b*. The proximal end of the mounting brackets 107*a*, 107*b* may be attached respectively to cam assemblies 104*a*, 104*b* at attachment points 138*a*, 138*b* where axles 139*a*, 139*b* may located.

Lower mounting brackets 124*a*, 124*b* (FIG. 2) may be attached at respective attachment points 141*a*, 141*b* on the bottom side of the riser 108. Lower mounting brackets 124*a*, 124*b* may be substantially planar and may extend from the attachment points 141 toward the proximal end 118. The proximal end of the lower mounting brackets 124*a*, 124*b* may be respectively attached to cam assemblies 104*a*, 104*b* at attachment points 167*a*, 167*b* where axles 139*a*, 139*b* may be located.

Figure 14:
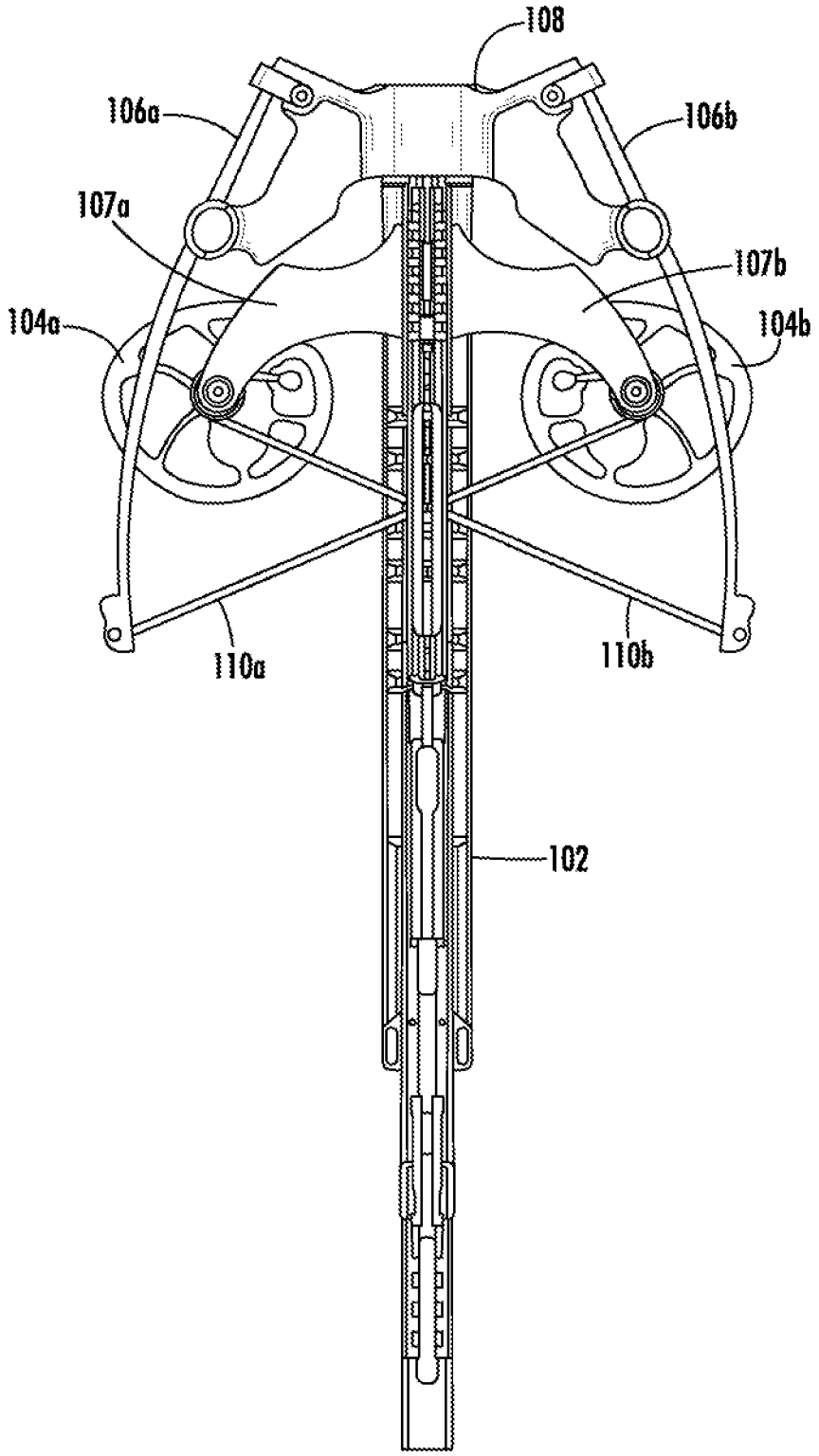
FIG. 14 is a top view of an embodiment of the crossbow with crossing cable system with mounting brackets affixed or integral with the flight track and the bow string in the uncocked position.
Figure 15:
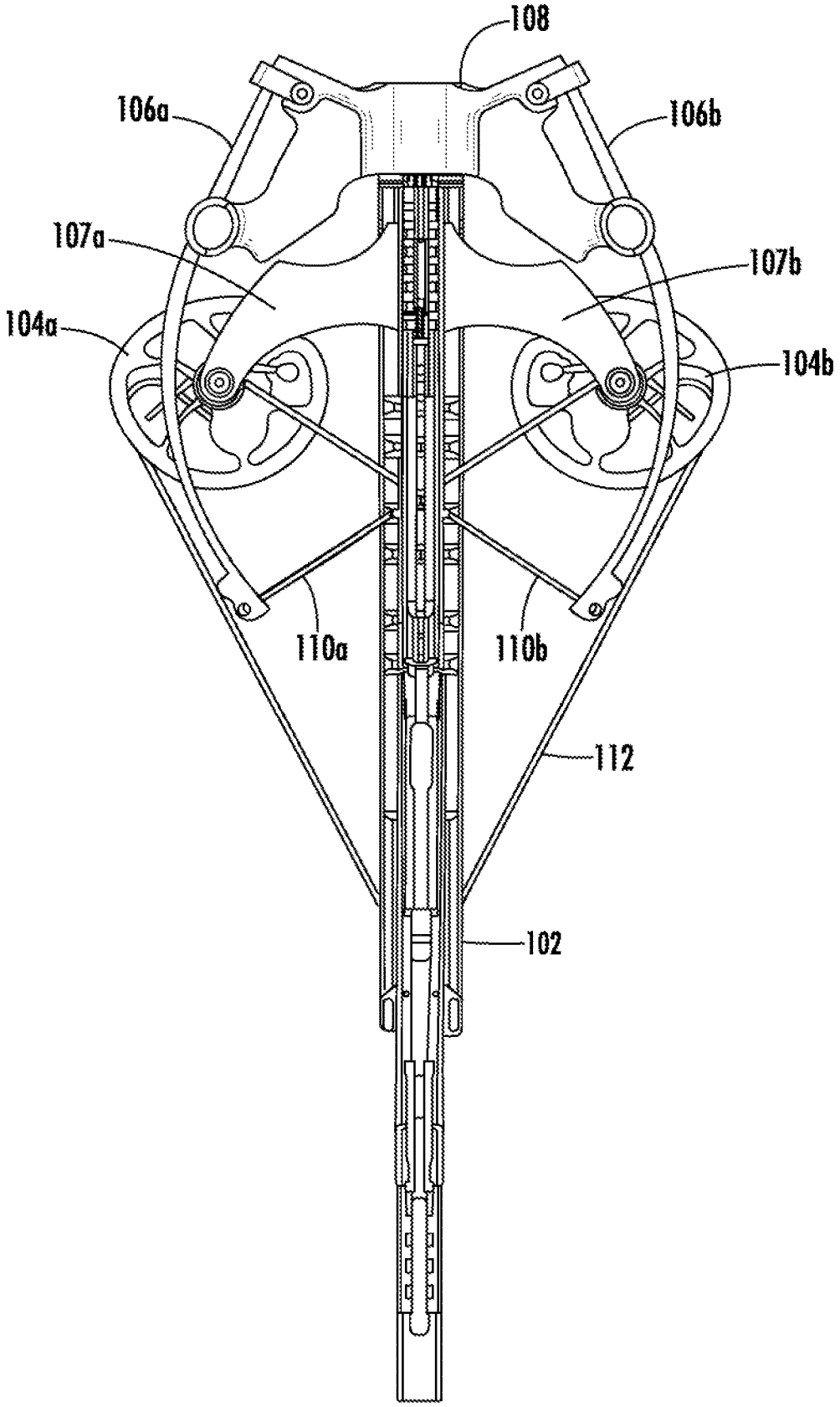
FIG. 15 is a top view of the crossbow with crossing cable system shown in FIG. 14 with the bow string in the cocked or full draw position.
Figure 16A:
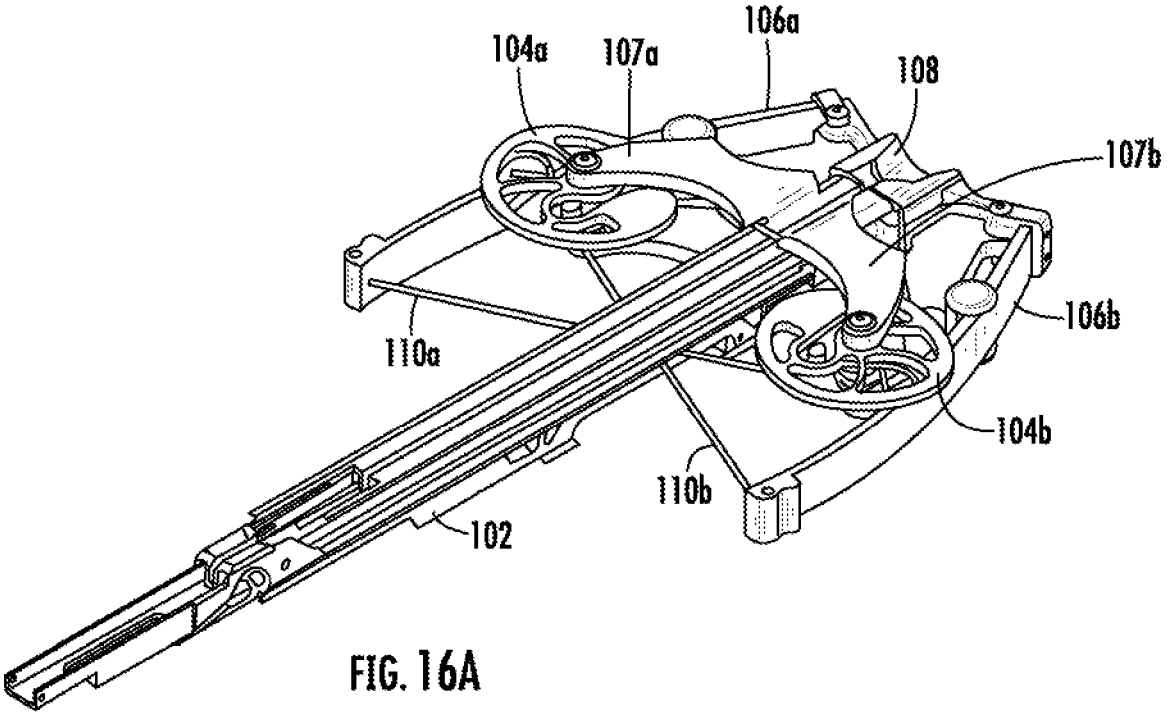
FIG. 16A is a perspective view of the crossbow with crossing cable system shown in FIG. 14.
Figure 16B:
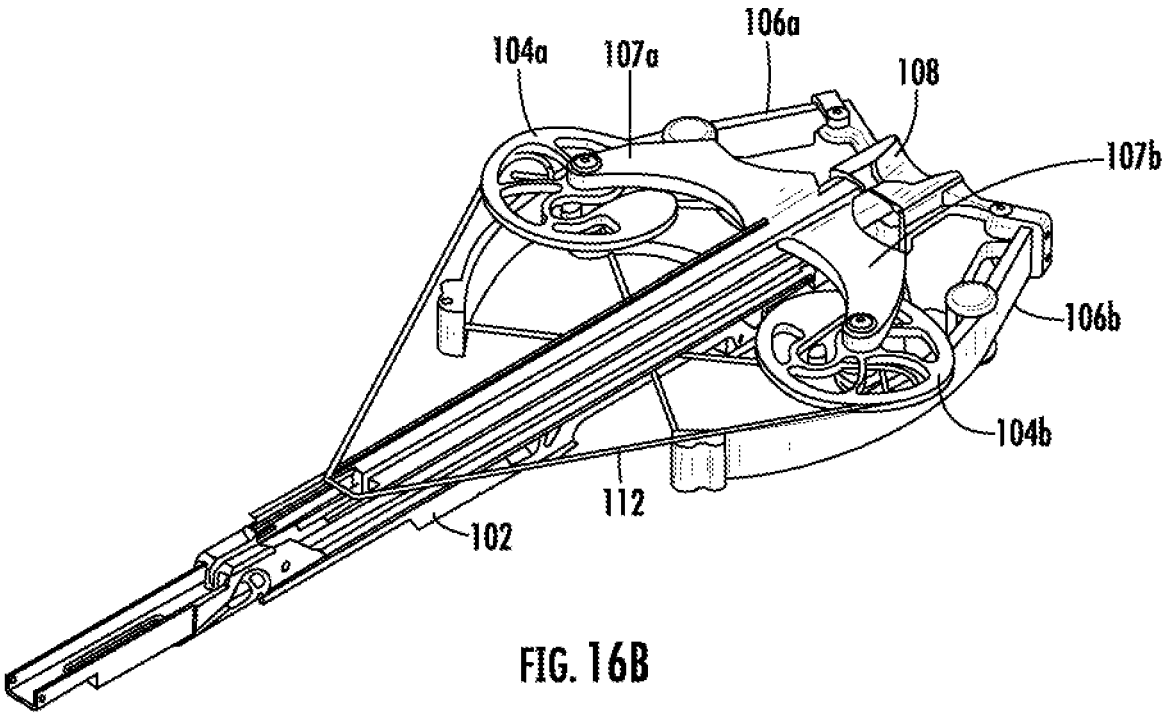
FIG. 16B is a perspective view of the crossbow with crossing cable system shown in FIG. 15.

In some embodiments, the upper mounting brackets 107*a* and 107*b* and/or the lower mounting brackets 124*a*, 124*b* may be integrally formed with the riser 108. For example, the brackets 107 and/or 124 may be integrally formed with the riser 108 as a single piece. In some embodiments, the brackets 107 and/or 124 may be mounted to the flight track (i.e., to the stock 102, as shown in FIGS. 14 and 16. In some embodiments, the brackets 107 and/or 124 may be integrally formed with the stock 102, and in other embodiments, the brackets 107 and/or 124 may be separate components that may be coupled by coupling means (bolts, etc.).

Figure 13A:
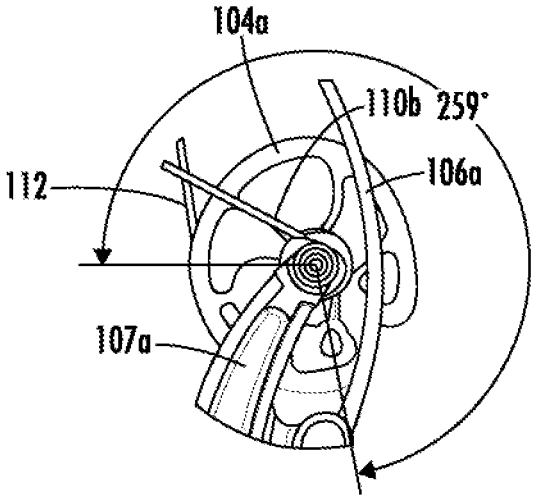
FIGS. 13A and 13B are each top views of the cam showing rotation of less than 270 degrees.
Figure 13B:
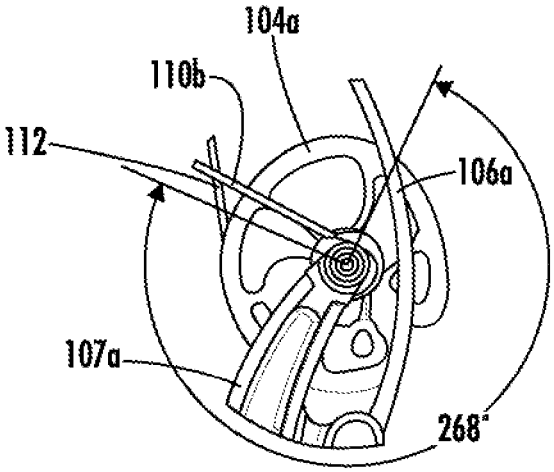

Cam assemblies 104*a*, 104*b* may have a first portion, which may be a generally circular-shaped cam body, and a second portion, which may be a power cable take-up assembly 126. Cam assemblies 104*a*, 104*b* may rotate about axles 139*a*, 139*b*. In some embodiments, cam assemblies 104*a*, 104*b* may rotate less than 270 degrees about the axles 139*a*,

139*b*. For example, cam assemblies 104*a*, 104*b* may rotate about 259 degrees when the crossbow 100/string 112 is transitioning from a brace or non-drawn position to a fully drawn position (see FIGS. 13A and 13B). In some embodiments, cam assemblies 104*a*, 104*b* may rotate more than 270 degrees about the axles 139*a*, 139*b*, such as rotating more than about 340 degrees. For example, cam assemblies may rotate in full circular rotation (360 degrees) about the axles 139*a*, 139*b* when the crossbow 100/string 112 is transitioning from a brace or non-drawn position to a fully drawn position (see FIGS. 10A, 10B, 10C, 11A, and 11B). The degrees of rotation may correspond or relate to the cam size/profile and/or to the spacing or number of helical take-up journals 146 (discussed further below). In some embodiments, the horizontal straight line distance between the axles 139*a*, 139*b* may be 8.5 inches and/or about 8.5 inches. In some cases, this distance may be greater than or may be less than 8.5 inches.

The top side of cam assemblies 104*a*, 104*b* may include cam-draw string attachment points 150*a*, 150*b*, which both may attach to ends of the draw string 112. The middle portion of draw string 112 may wrap around the cam assemblies 104 in cam draw string guides 148*a*, 148*b*. The draw string 112 may cross the centerline 101 above the stock 102 (i.e., flight track), as shown in FIG. 1. As the draw string 112 is drawn back along centerline 102 toward the proximal end 118, the tension in the draw string 112 increases. The main circular body of the cams 104 where the draw string 112 interacts with the cams 104 may be elevated and set vertically higher than the limbs 106. In some embodiments, the main circular body of the cams 104 where the draw string 112 interacts with the cams 104 may be set vertically lower than the limbs 106 (See FIGS. 19, 20A, 20B, 21, and 22).

Figure 17A:
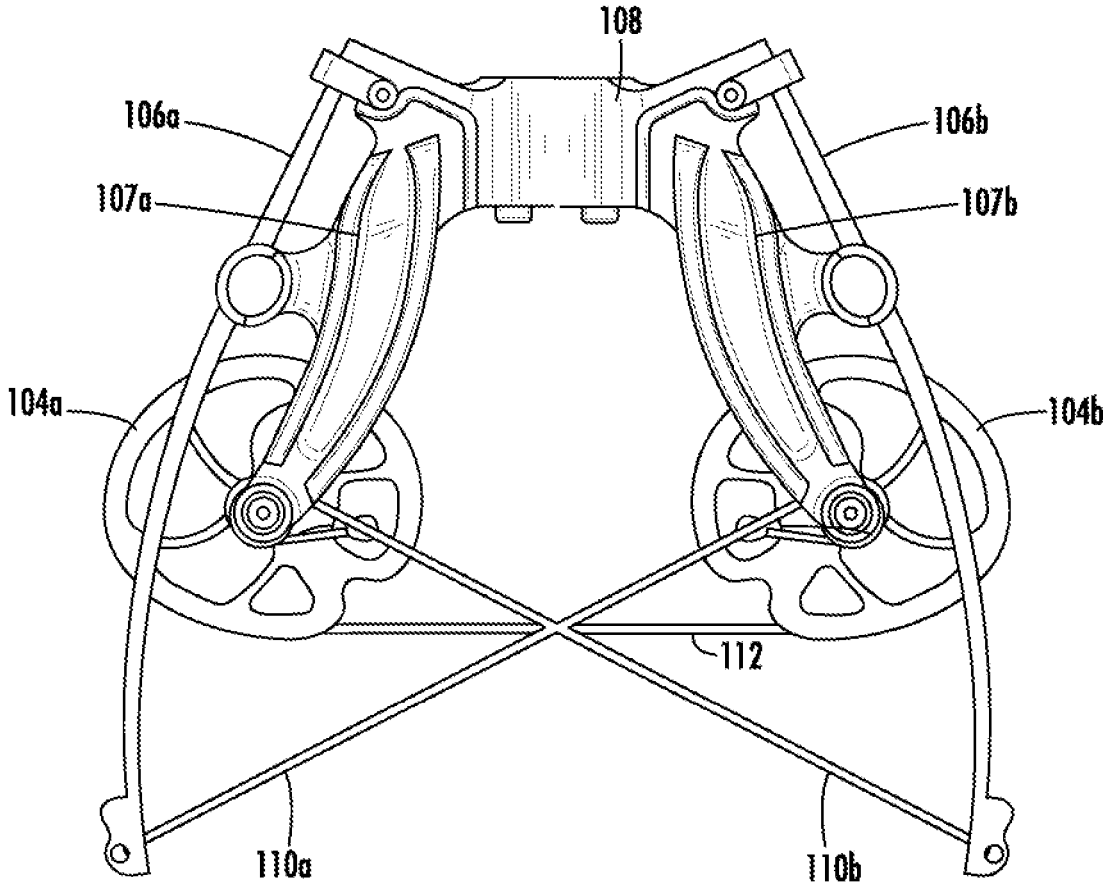
FIG. 17A is a top view of an embodiment of a bow assembly of the crossbow with crossing cable system with the bow string in the uncocked position and extending between cams at journals at the rear of the cams or proximal to the shooter.
Figure 17B:
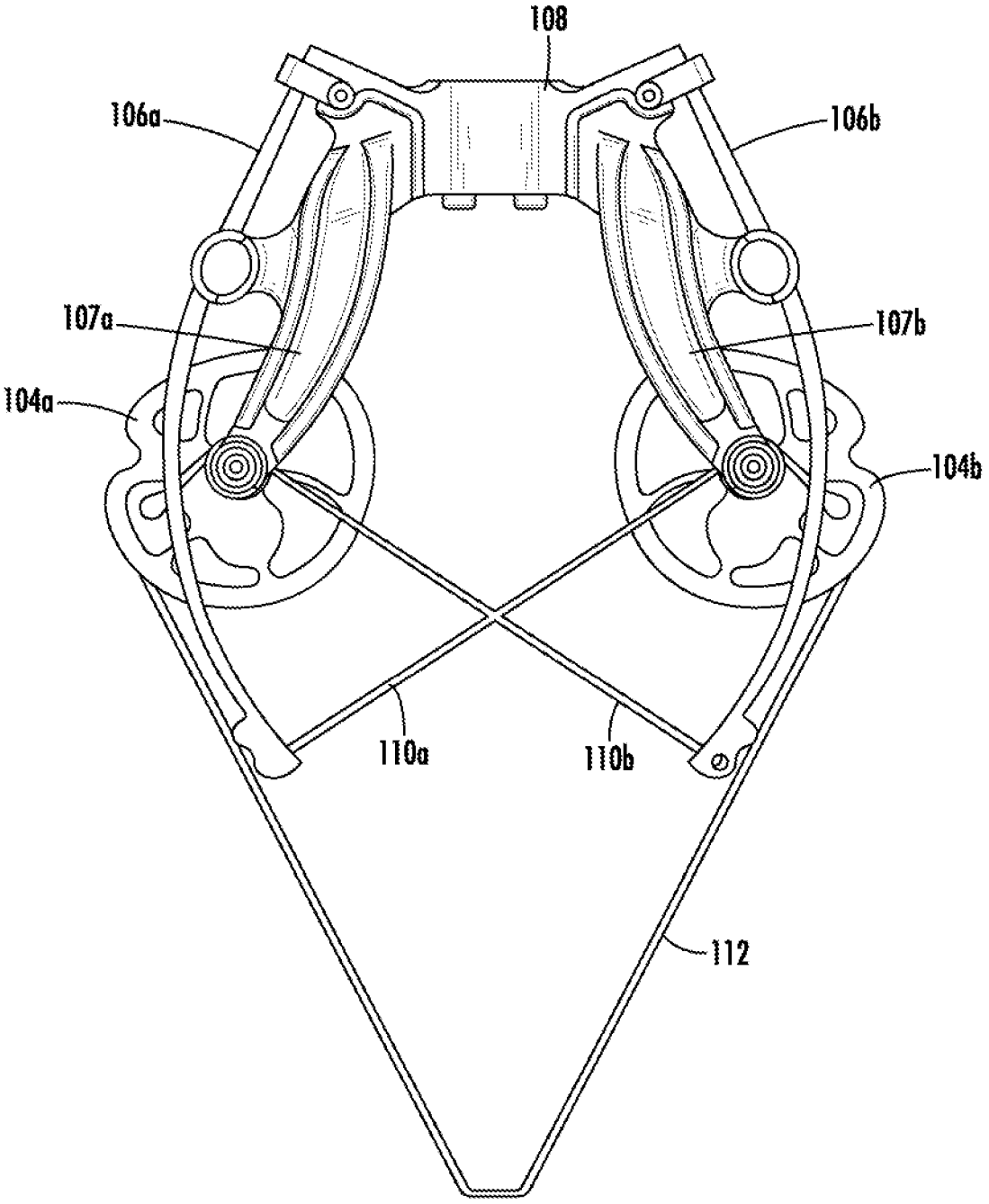
FIG. 17B is a top view of the bow assembly shown in FIG. 17A with the bow string in the cocked position.

As shown in FIGS. 1-4, the draw string 112 may be situated between the cams 104 in a more distal location from a shooter. That is, in a brace position, the draw string 112 may cross the centerline 101 between more distal portions of the respective bodies of the cams 104 via the respective distal portions of the draw string guides 148. In some embodiments, the draw string 112 may be situated between the cams 104 in a more proximal location from a shooter. That is, in a brace position, the draw string 112 may cross/traverse the centerline 101 between more proximal portions of the respective bodies of the cams 104 via the respective proximal portions of the draw string guides 148 (see FIGS. 17 and 18).

Figure 4:
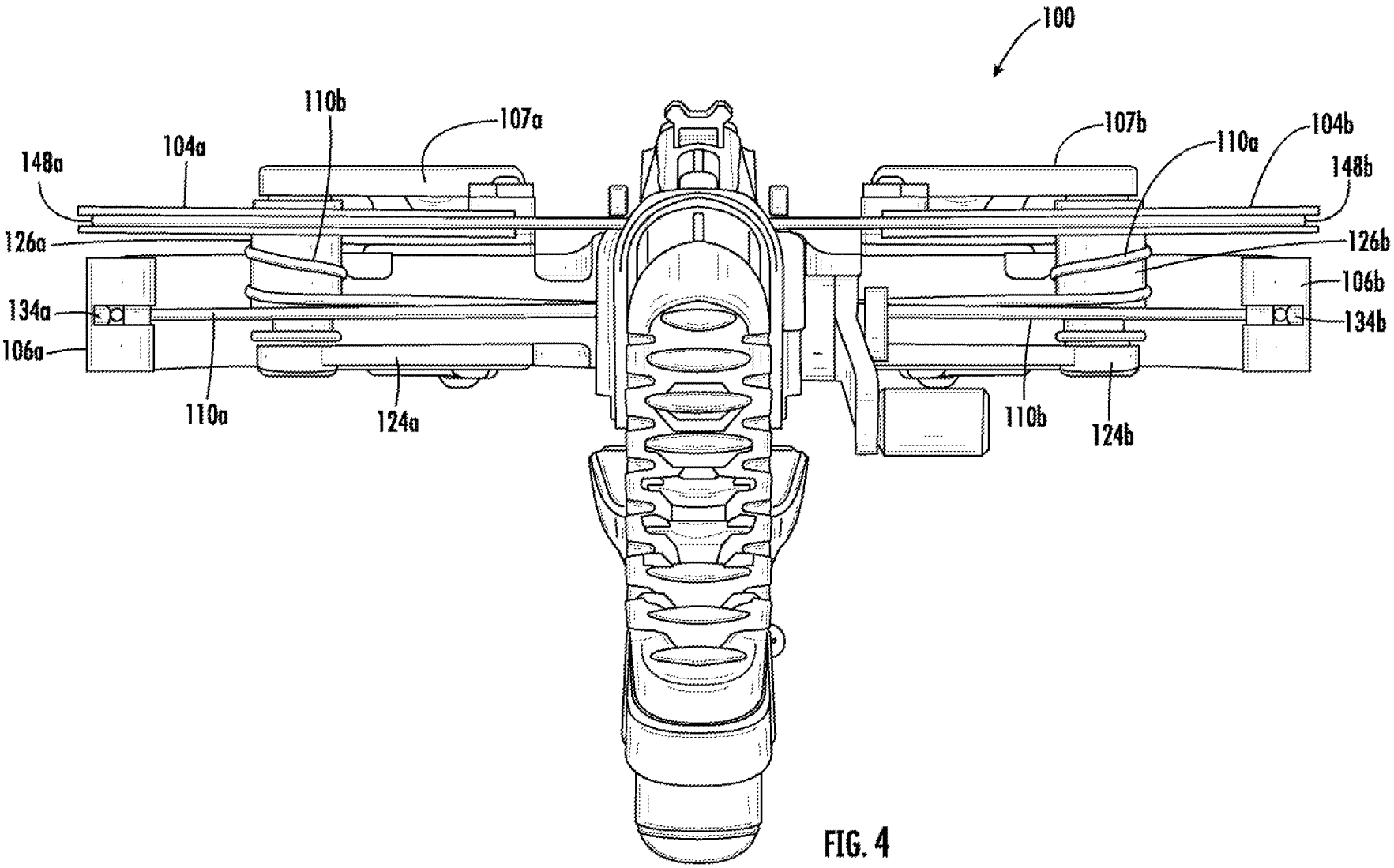
FIG. 4 is a rear view of an embodiment of the crossbow with crossing cable system.
Figure 5A:
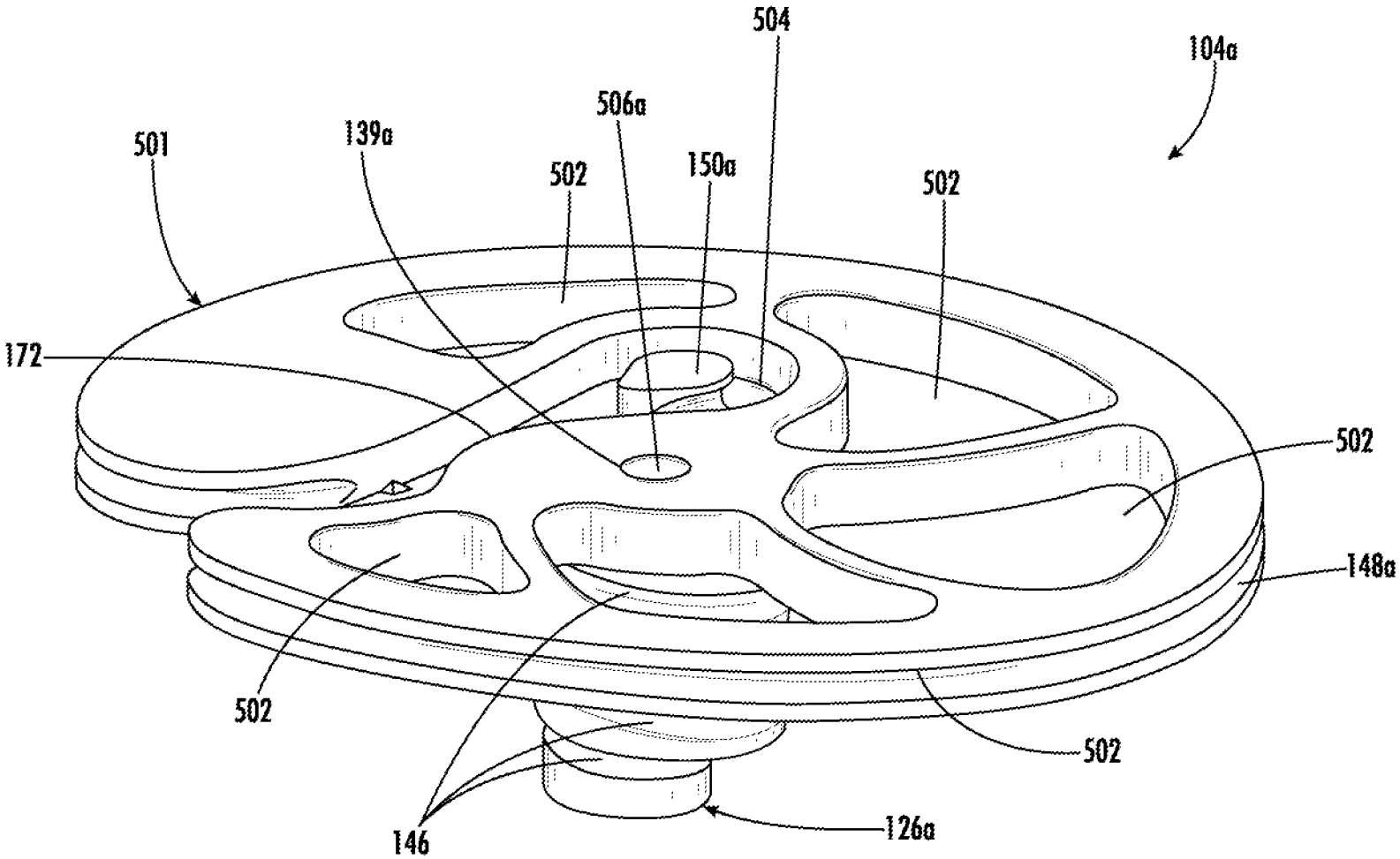
FIG. 5A is a top perspective view of an embodiment of a cam assembly of the crossbow with crossing cable system.
Figure 5B:
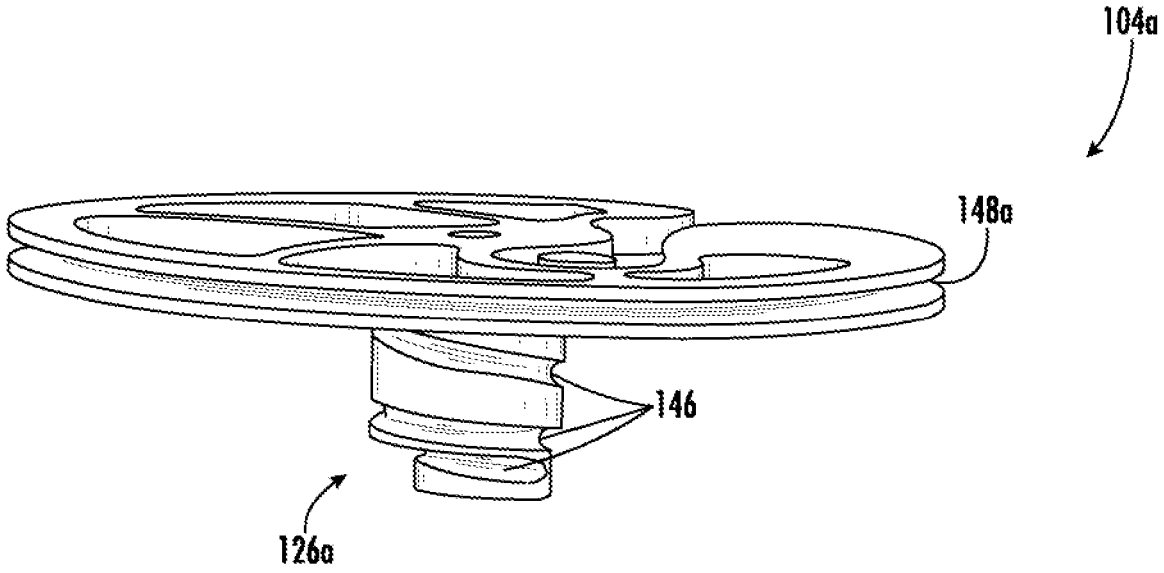
FIG. 5B is a side perspective view of the cam assembly shown in FIG. 5A.
Figure 5C:
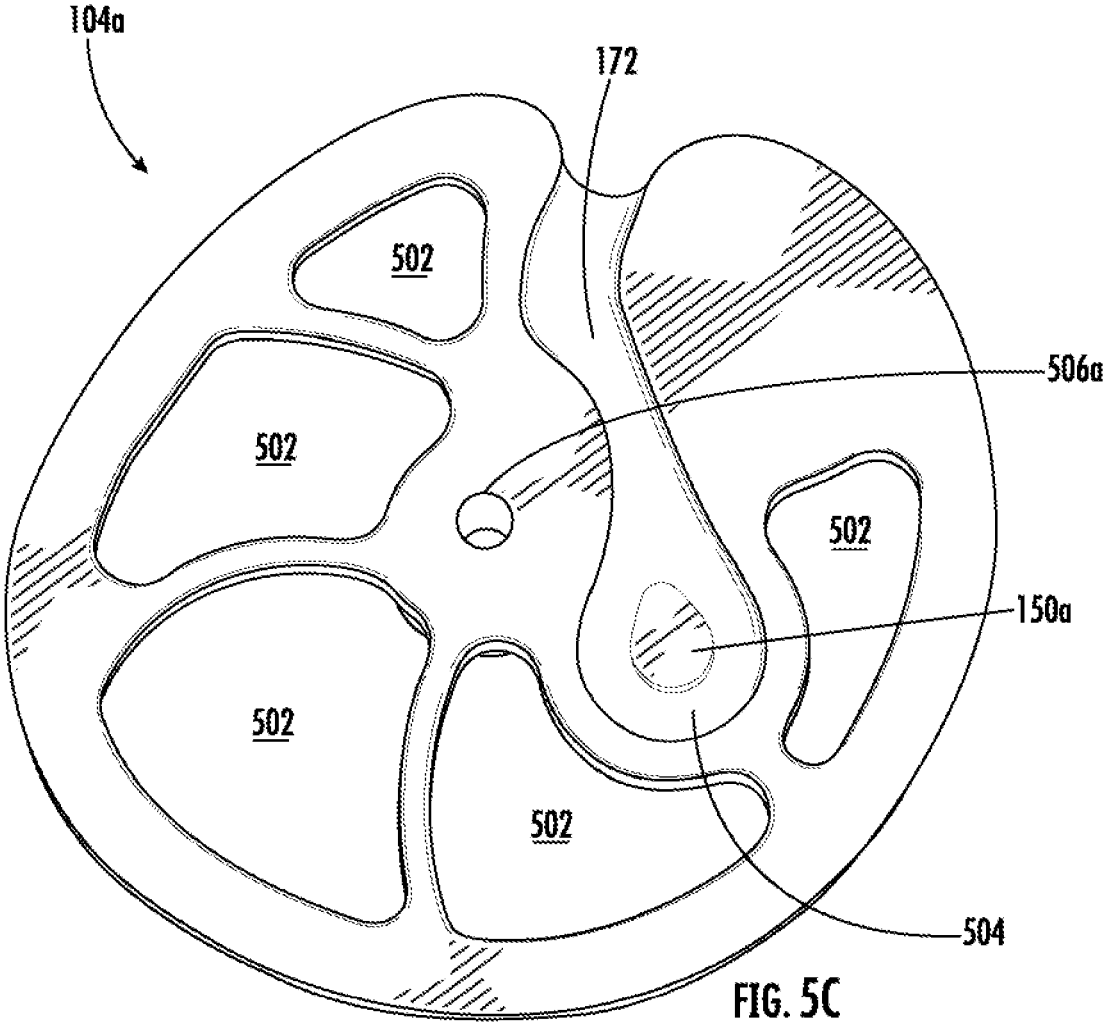
FIG. 5C is a top perspective view of the cam assembly shown in FIG. 5A.
Figure 5D:
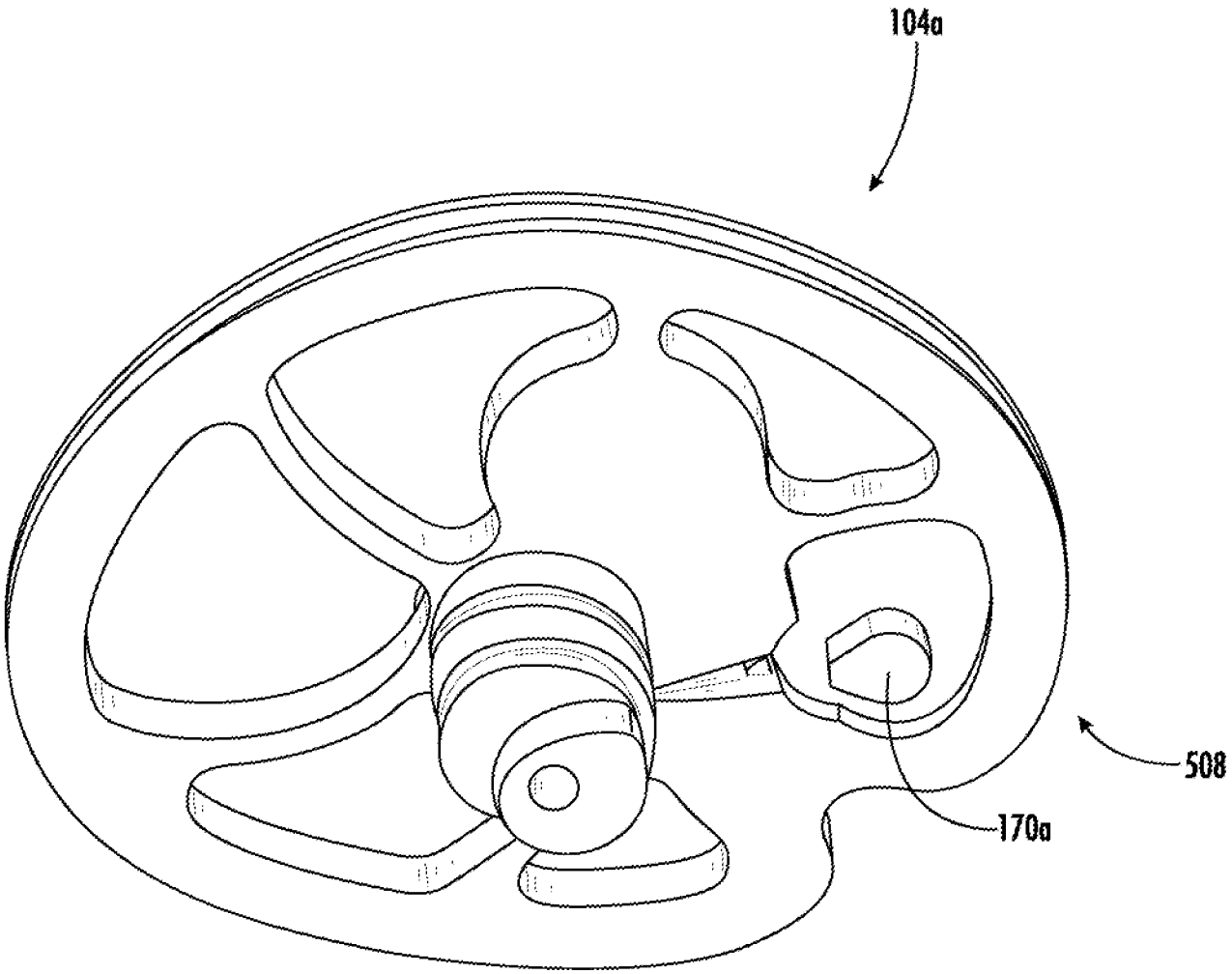
FIG. 5D is a bottom perspective view of the cam assembly shown in FIG. 5A.
Figure 5E:
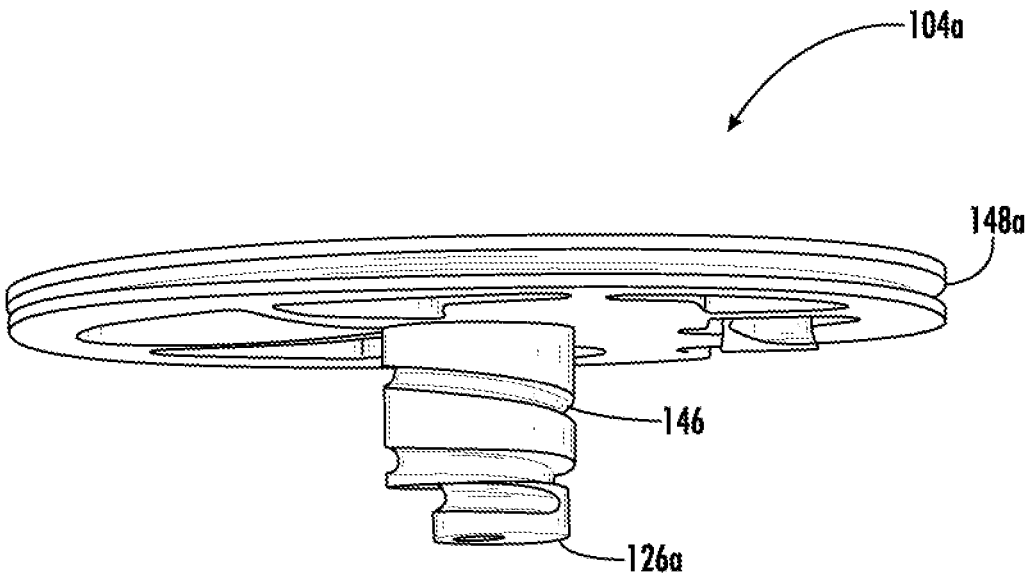
FIG. 5E is bottom-side perspective view of the cam assembly shown in FIG. 5A.
Figure 6A:
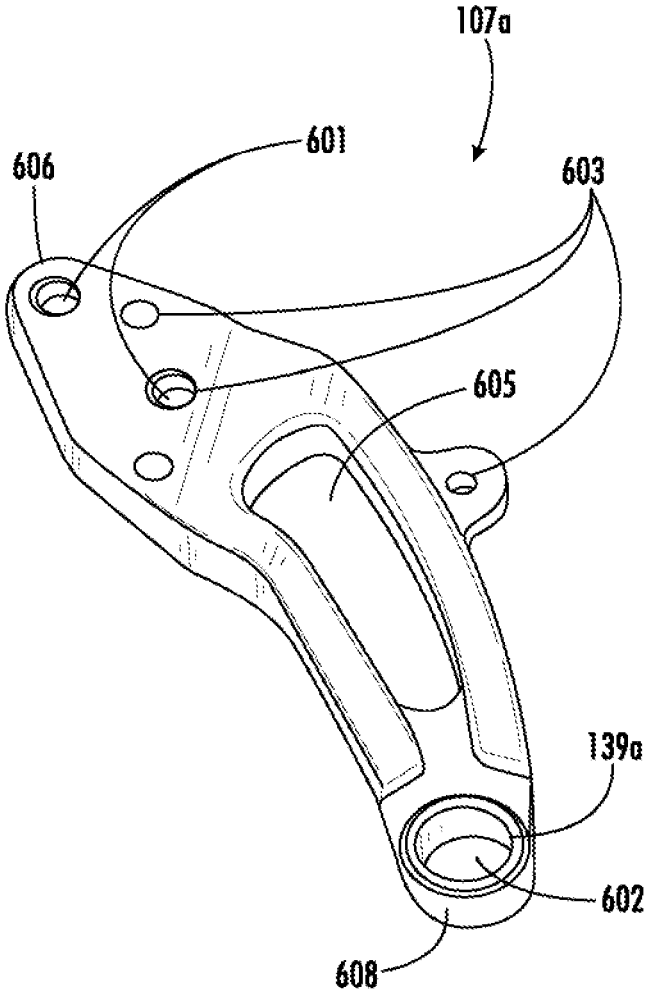
FIG. 6A is a top perspective view of an embodiment of an upper mounting bracket of the crossbow with crossing cable system.
Figure 6B:
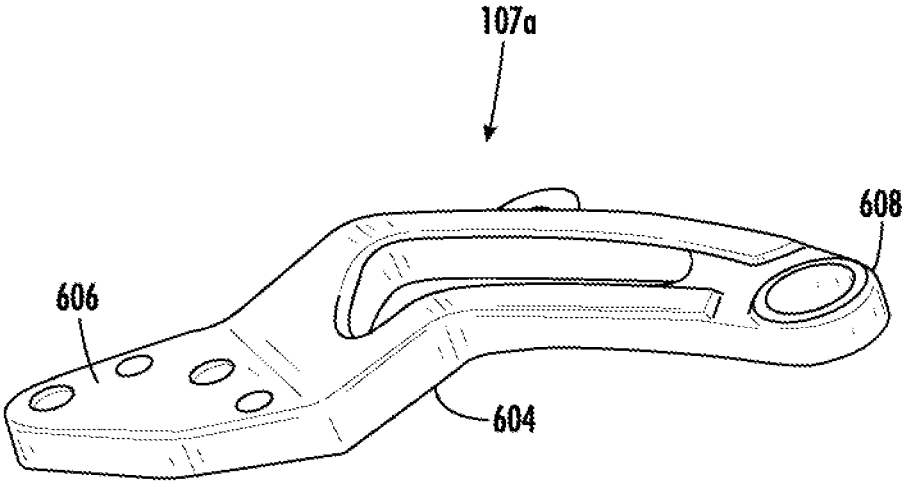
FIG. 6B is a side perspective view of the upper mounting bracket shown in FIG. 6A.
Figure 6C:
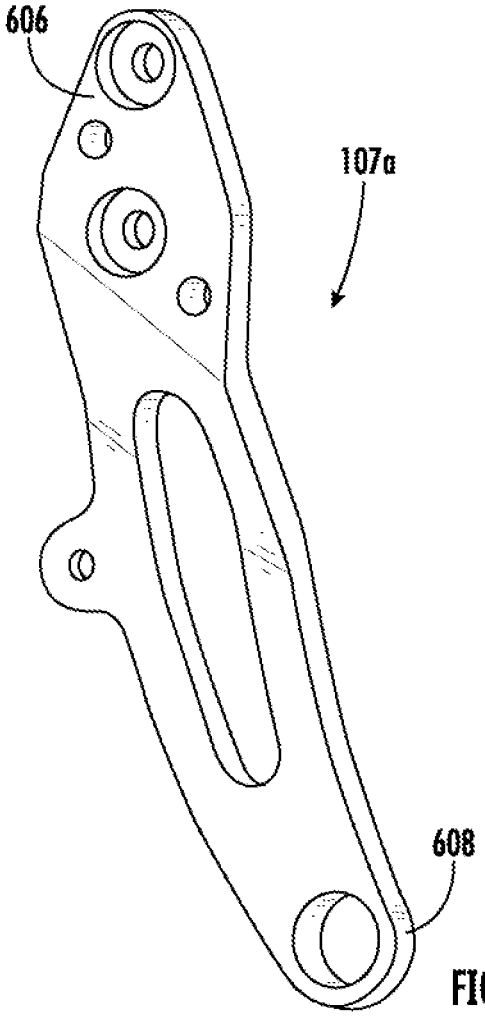
FIG. 6C is a bottom perspective view of the upper mounting bracket shown in FIG. 6A.
Figure 6D:
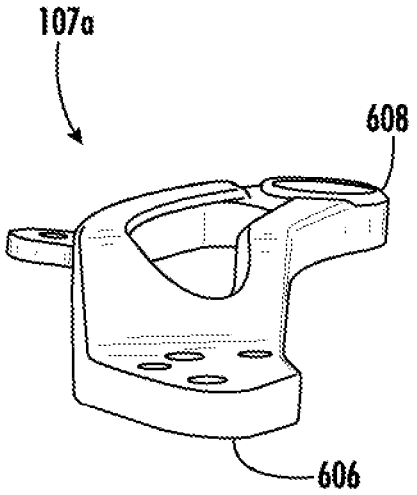
FIG. 6D is a side perspective view of the upper mounting bracket shown in FIG. 6A.
Figure 6E:
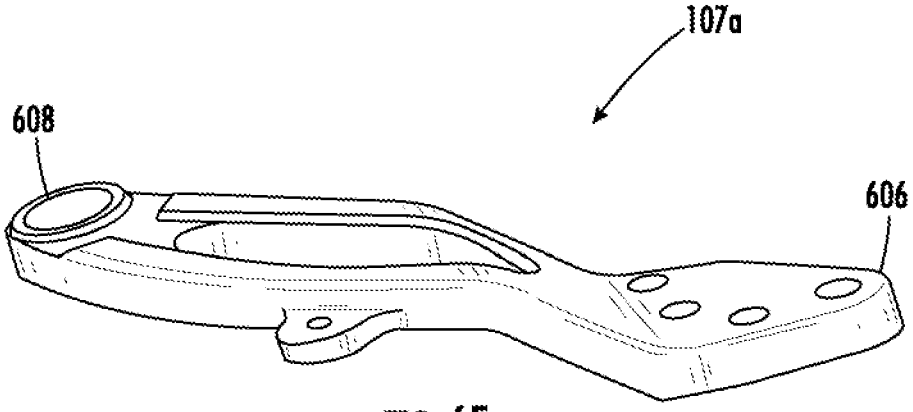
FIG. 6E is a side perspective view of the upper mounting bracket shown in FIG. 6A.
Figure 7A:
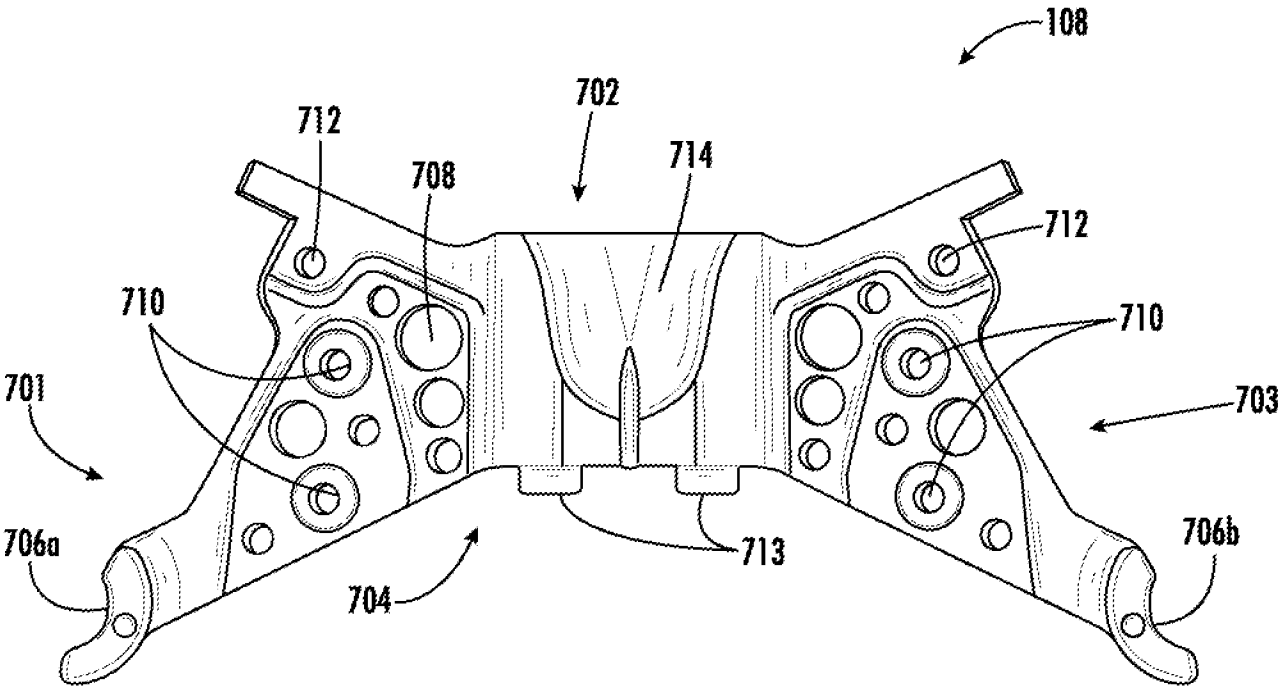
FIG. 7A is a top view of an embodiment of a riser of the crossbow with crossing cable system.
Figure 7B:
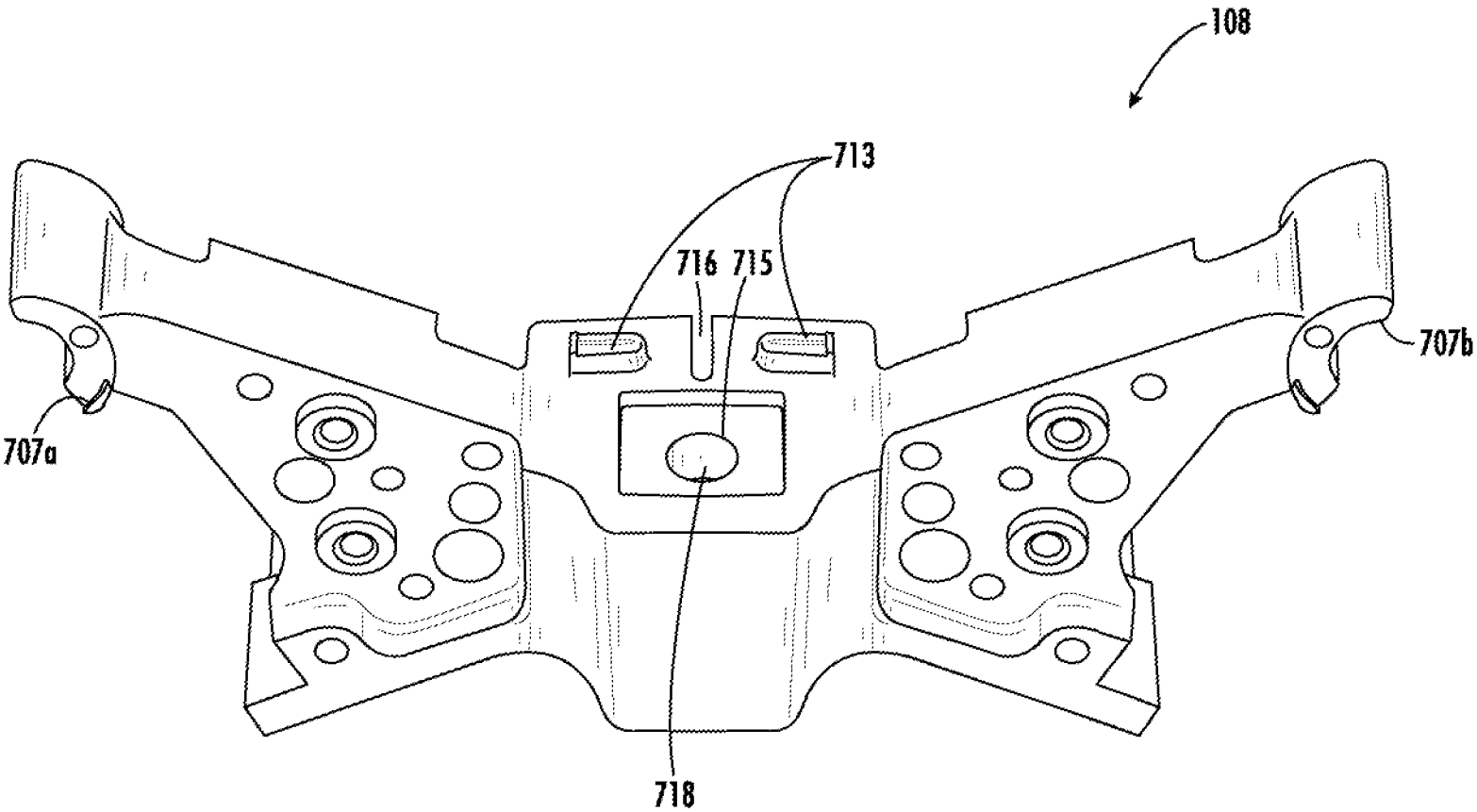
FIG. 7B is a bottom, rearward perspective view of the riser shown in FIG. 7A.
Figure 7C:
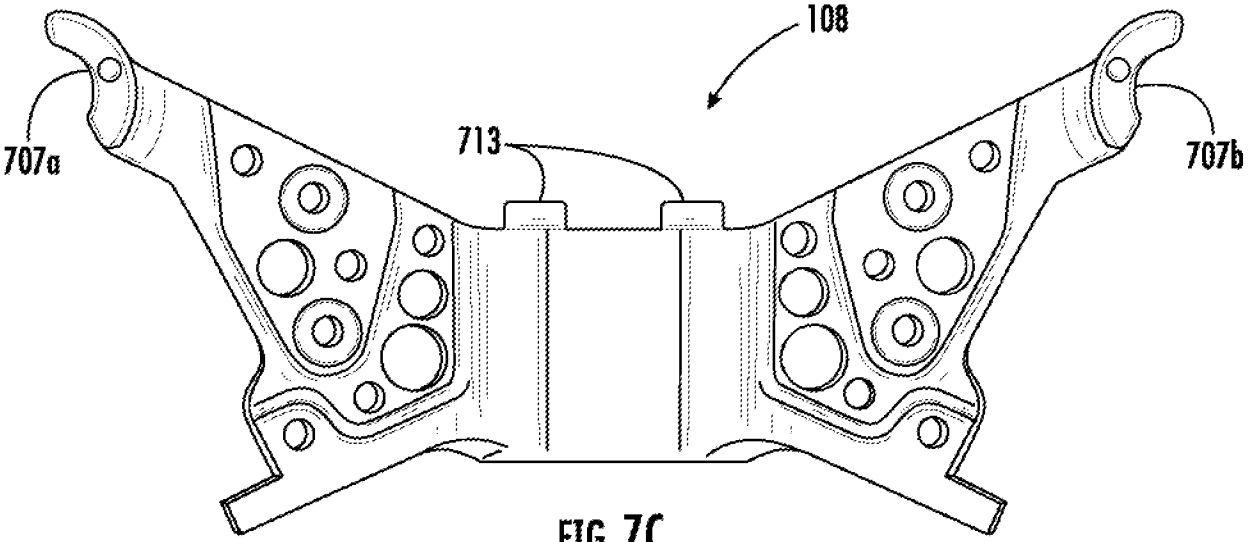
FIG. 7C is a bottom view of the riser shown in FIG. 7A.
Figure 7D:
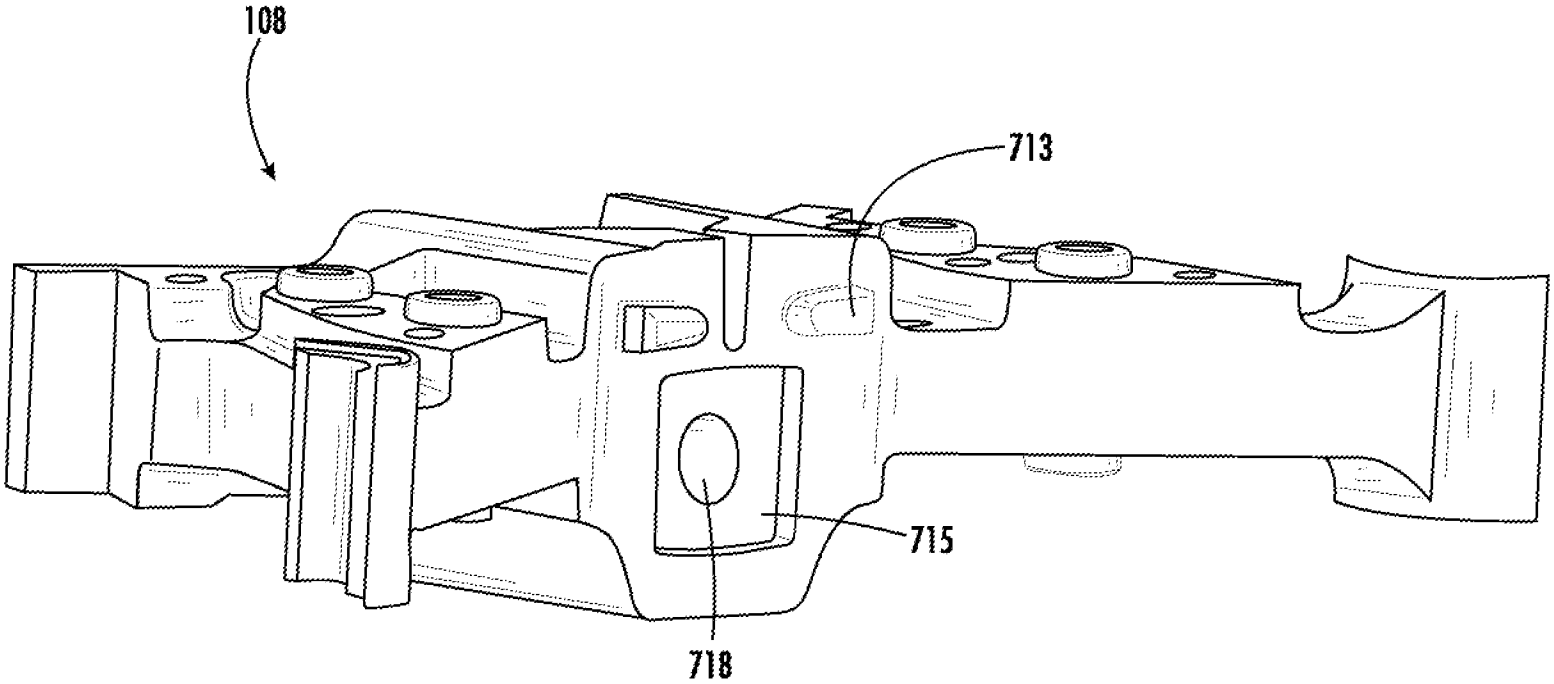
FIG. 7D is a rear perspective view of the riser shown in FIG. 7A.
Figure 7E:
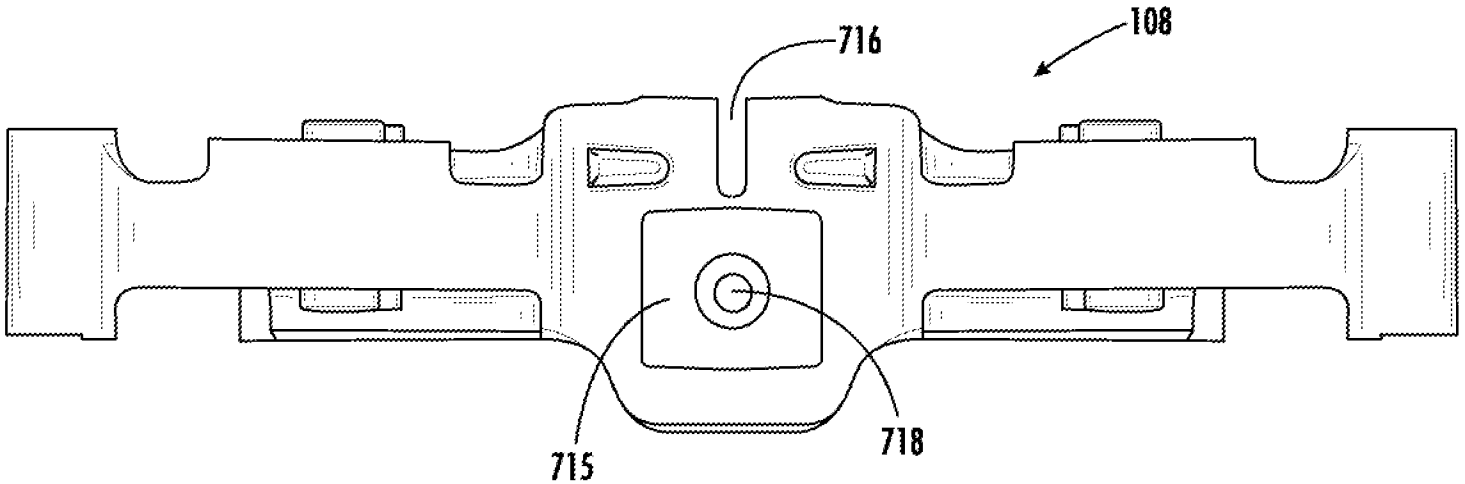
FIG. 7E is a rear view of the riser shown in FIG. 7A.
Figure 7F:
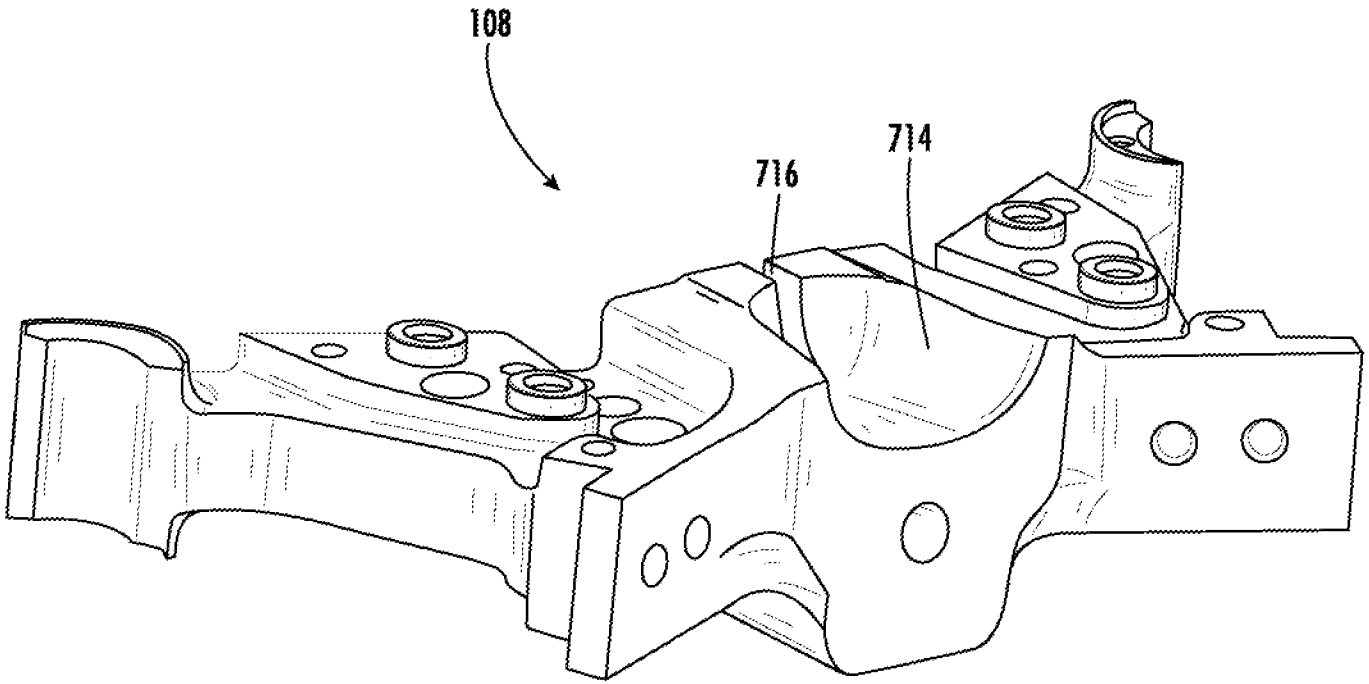
FIG. 7F is a front perspective view of the riser shown in FIG. 7A.
Figure 7G:
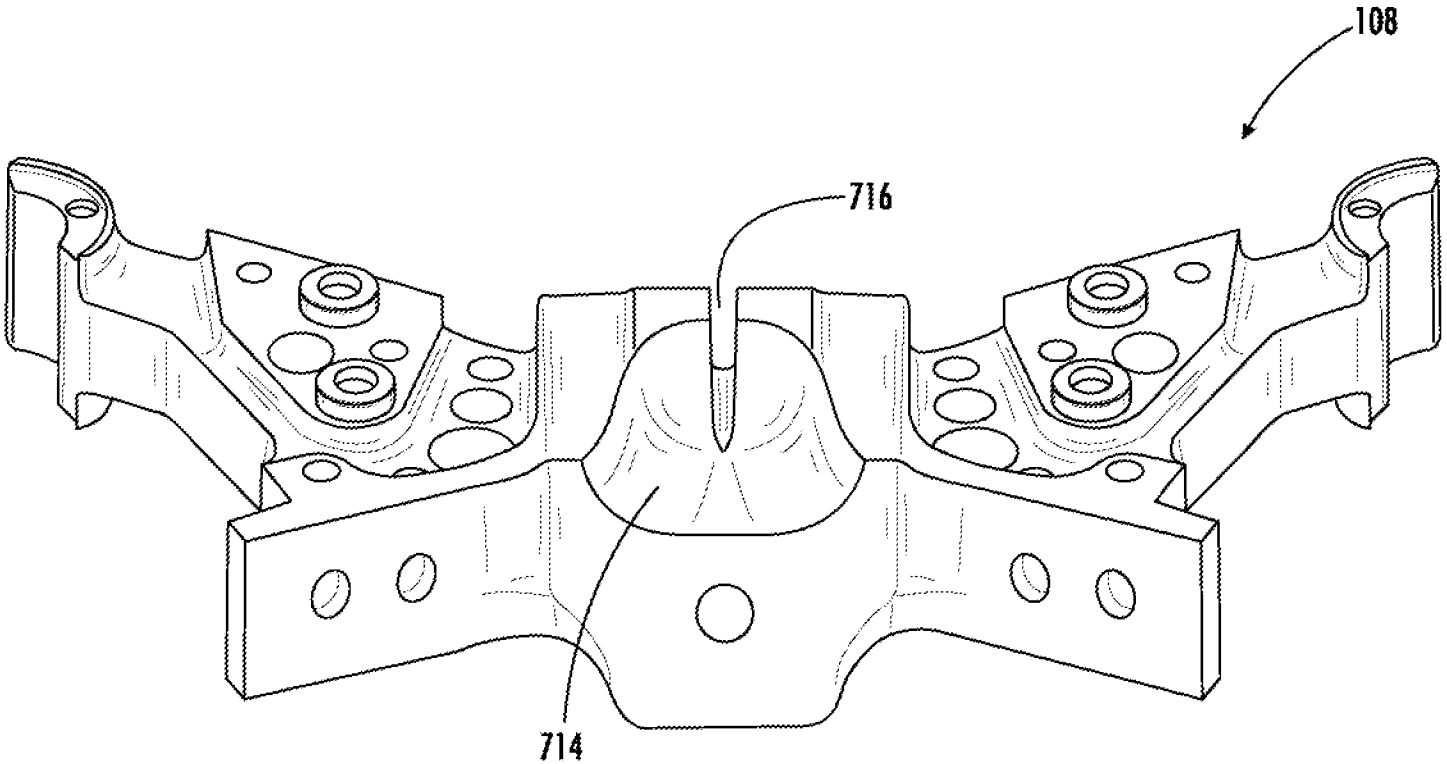
FIG. 7G is a top front perspective view of the riser shown in FIG. 7A.
Figure 7H:
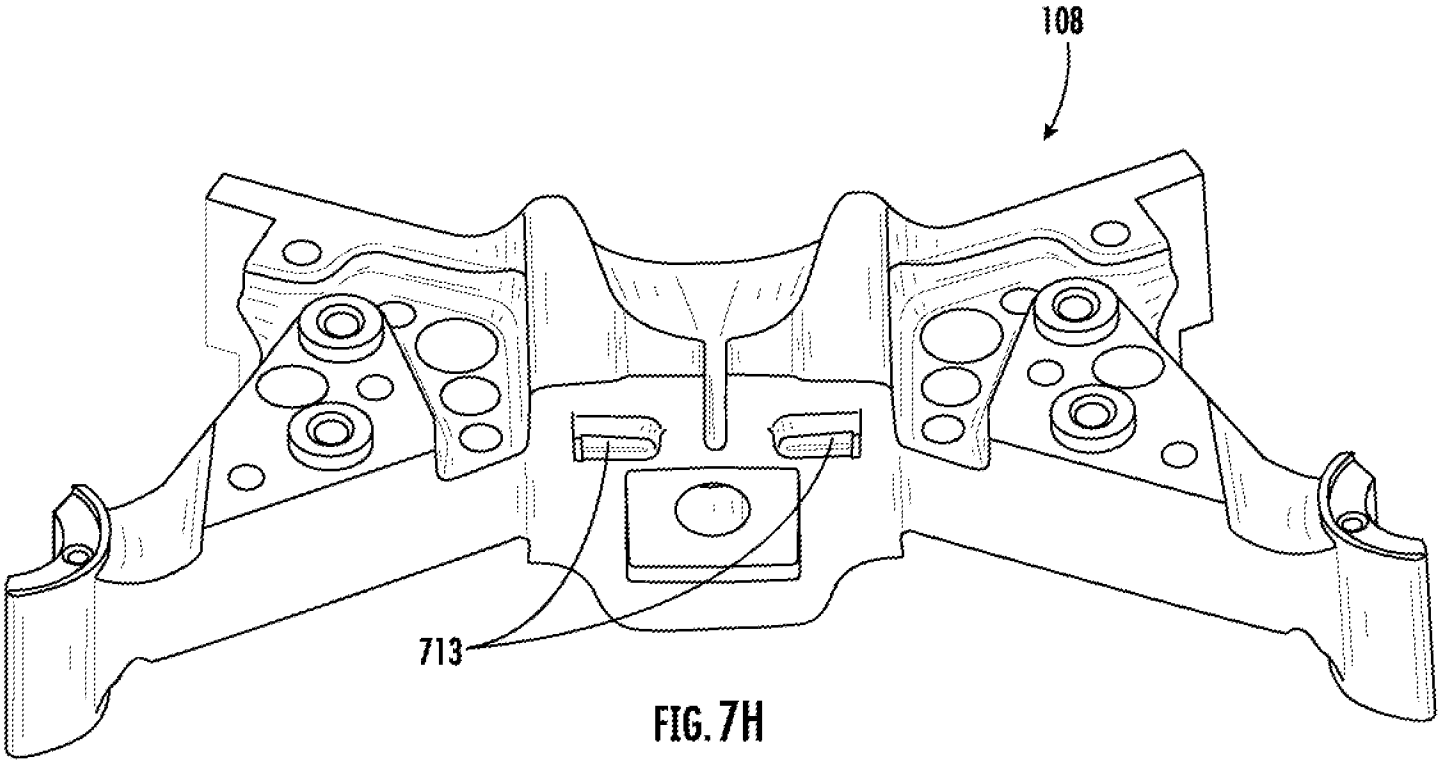
FIG. 7H is a top rear perspective view of the riser shown in FIG. 7A.
Figure 7I:
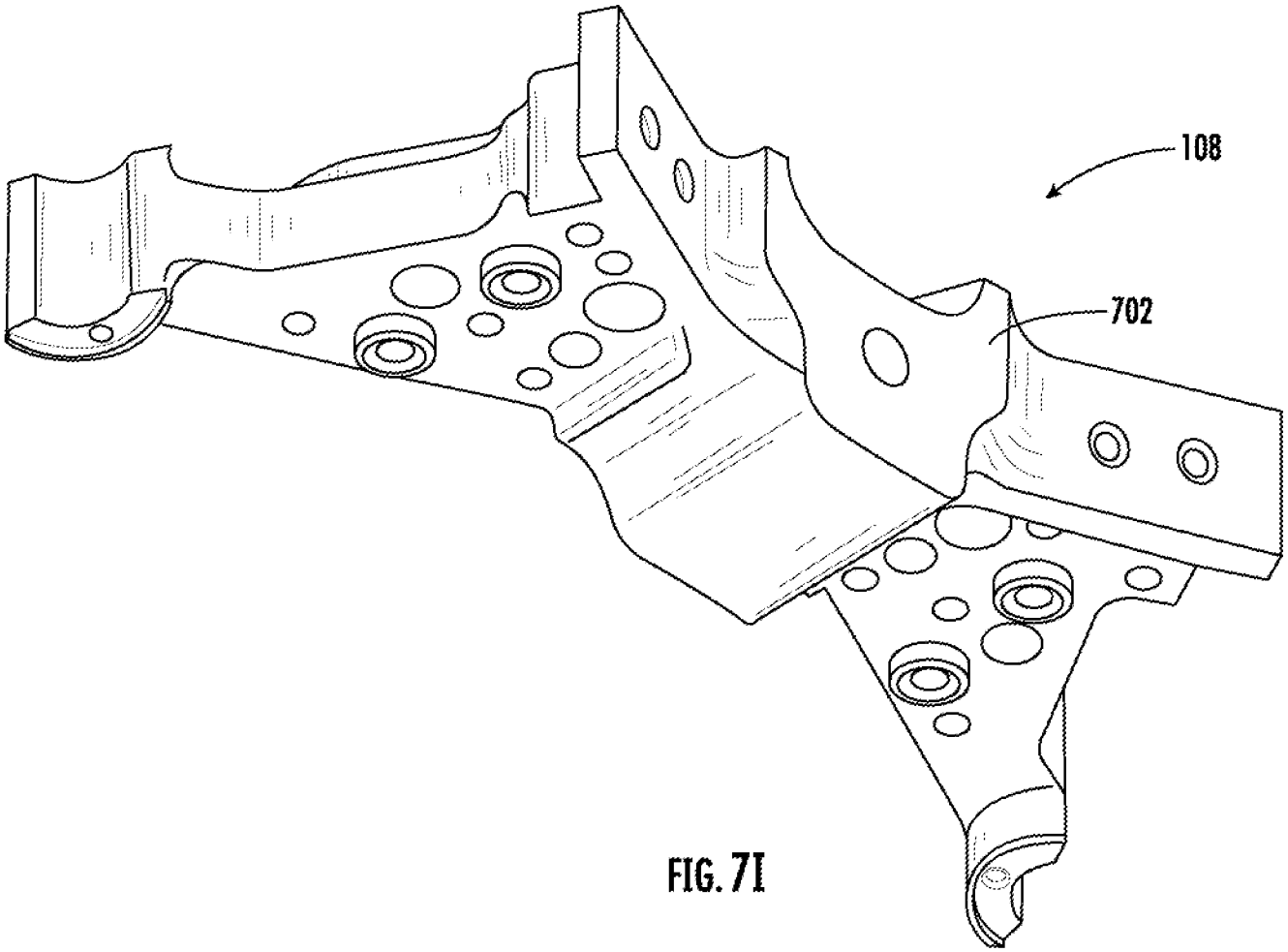
FIG. 7I is a bottom perspective view of the riser shown in FIG. 7A.
Figure 8A:
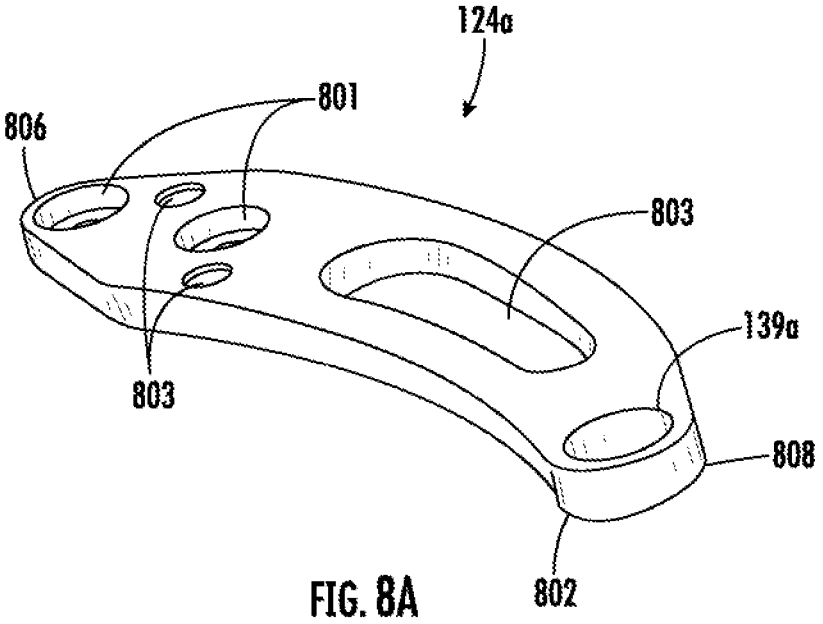
FIG. 8A is a rear perspective view an embodiment of a lower mounting bracket of the crossbow with crossing cable system.
Figure 8B:
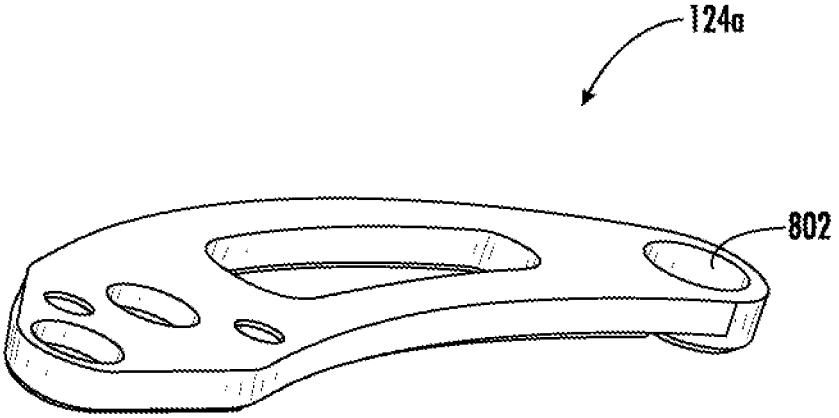
FIG. 8B is a front perspective view the lower mounting bracket shown in FIG. 8A.
Figure 8C:
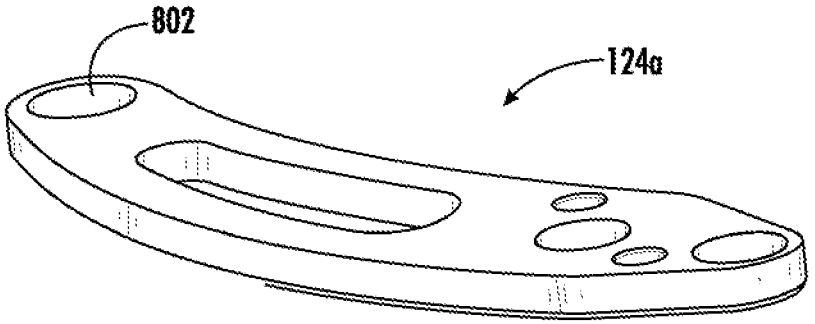
FIG. 8C is a side perspective view the lower mounting bracket shown in FIG. 8A.
Figure 8D:
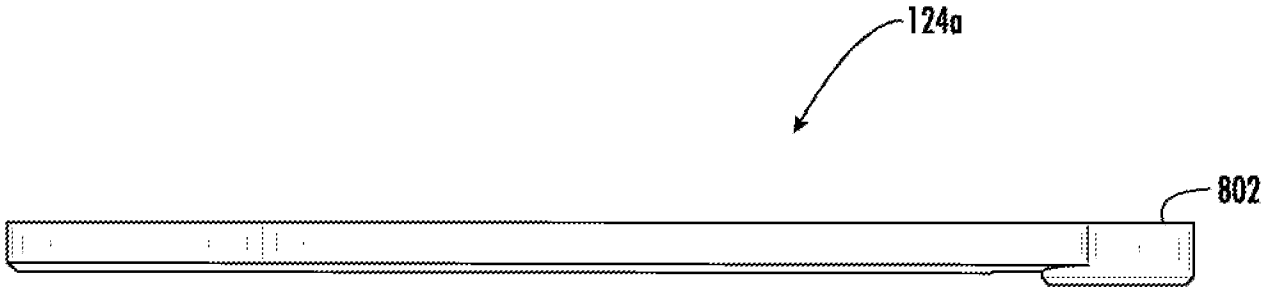
FIG. 8D is a side view the lower mounting bracket shown in FIG. 8A.
Figure 8E:
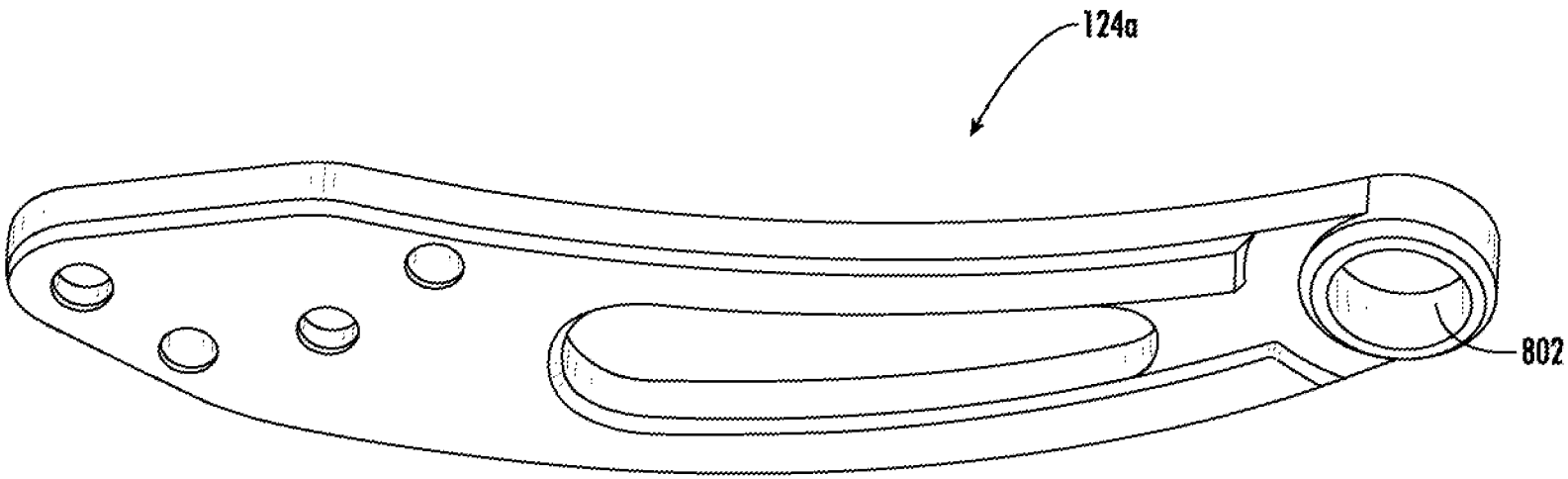
FIG. 8E is a bottom perspective view the lower mounting bracket shown in FIG. 8A.
Figure 9A:
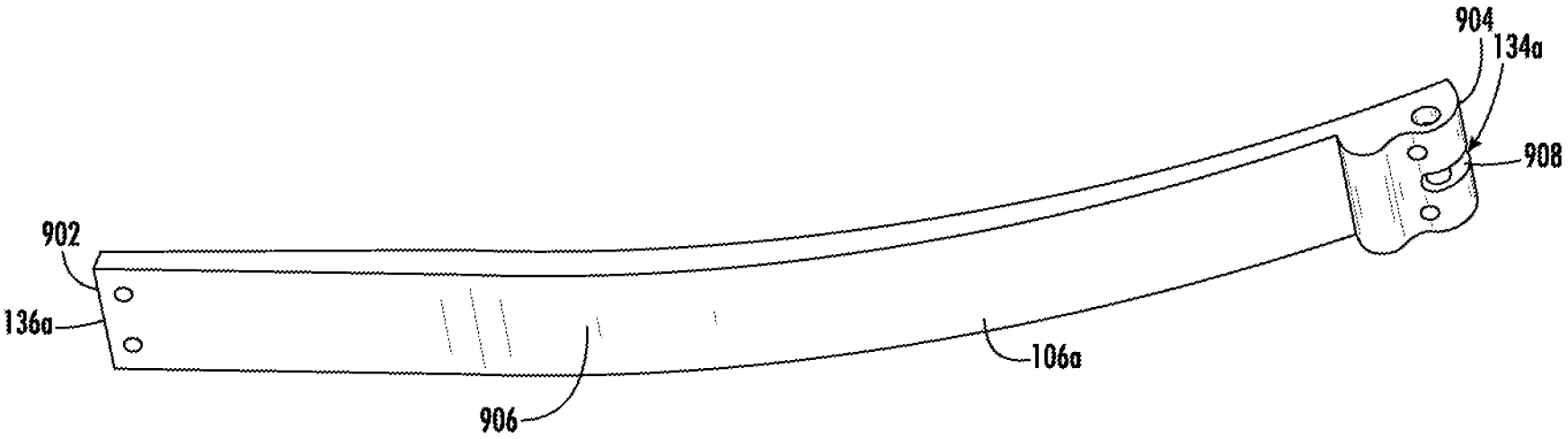
FIG. 9A is a side perspective view of an embodiment of a limb of the crossbow with crossing cable system.
Figure 9B:
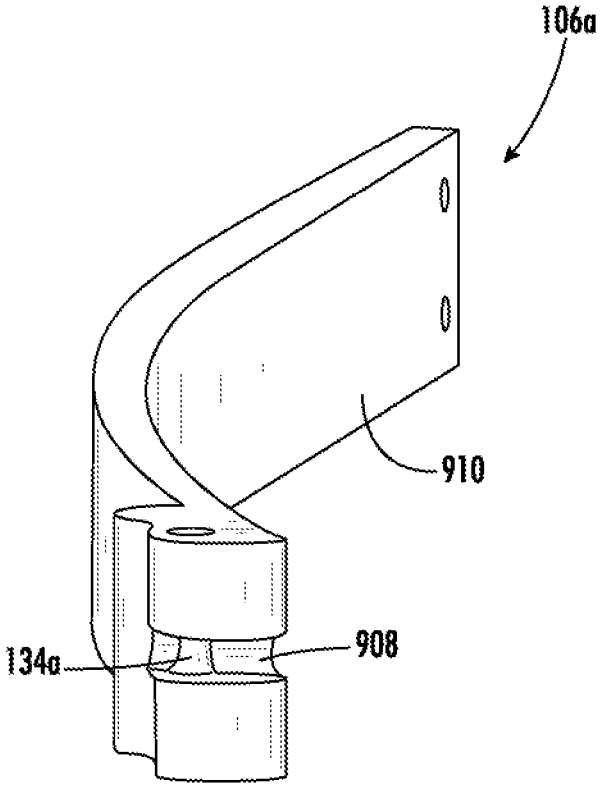
FIG. 9B is a rear perspective view of the limb shown in FIG. 9A.
Figure 9C:
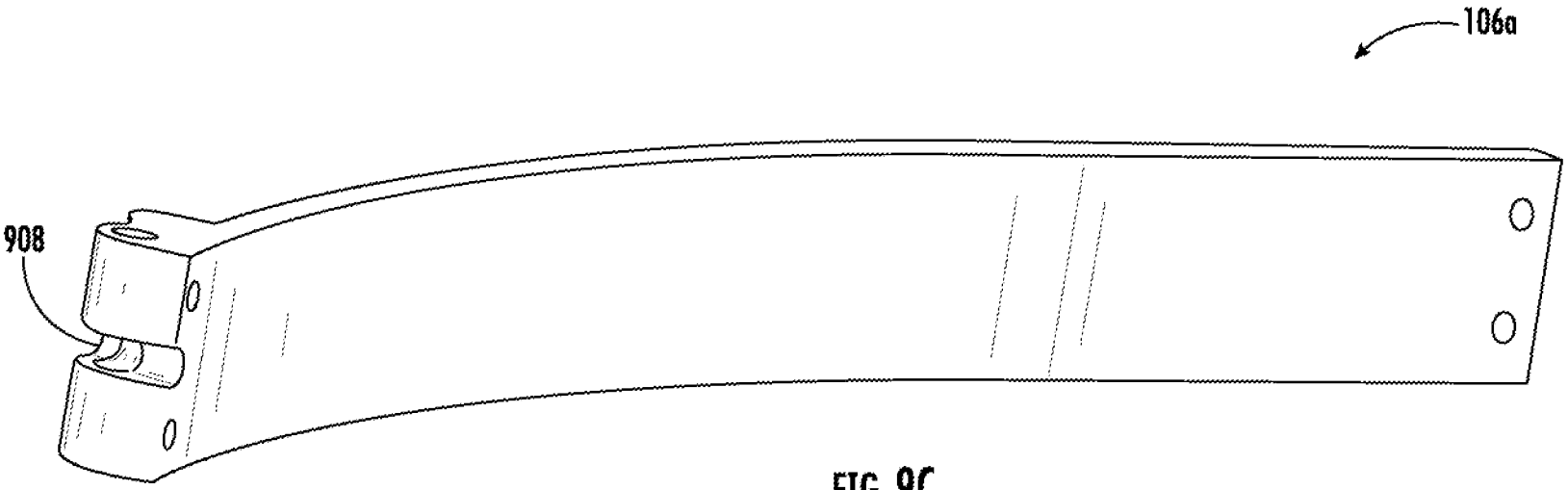
FIG. 9C is a side perspective view of the limb shown in FIG. 9A.
Figure 9D:
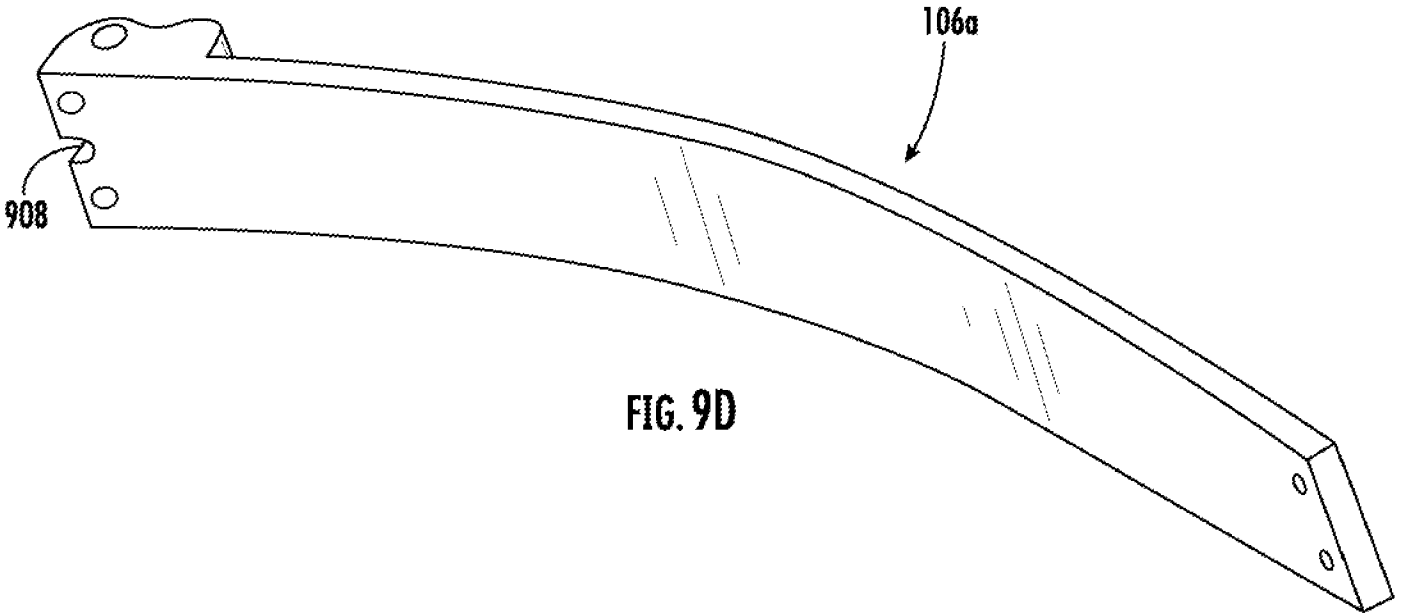
FIG. 9D is side perspective view of the limb shown in FIG. 9A.
Figure 9E:
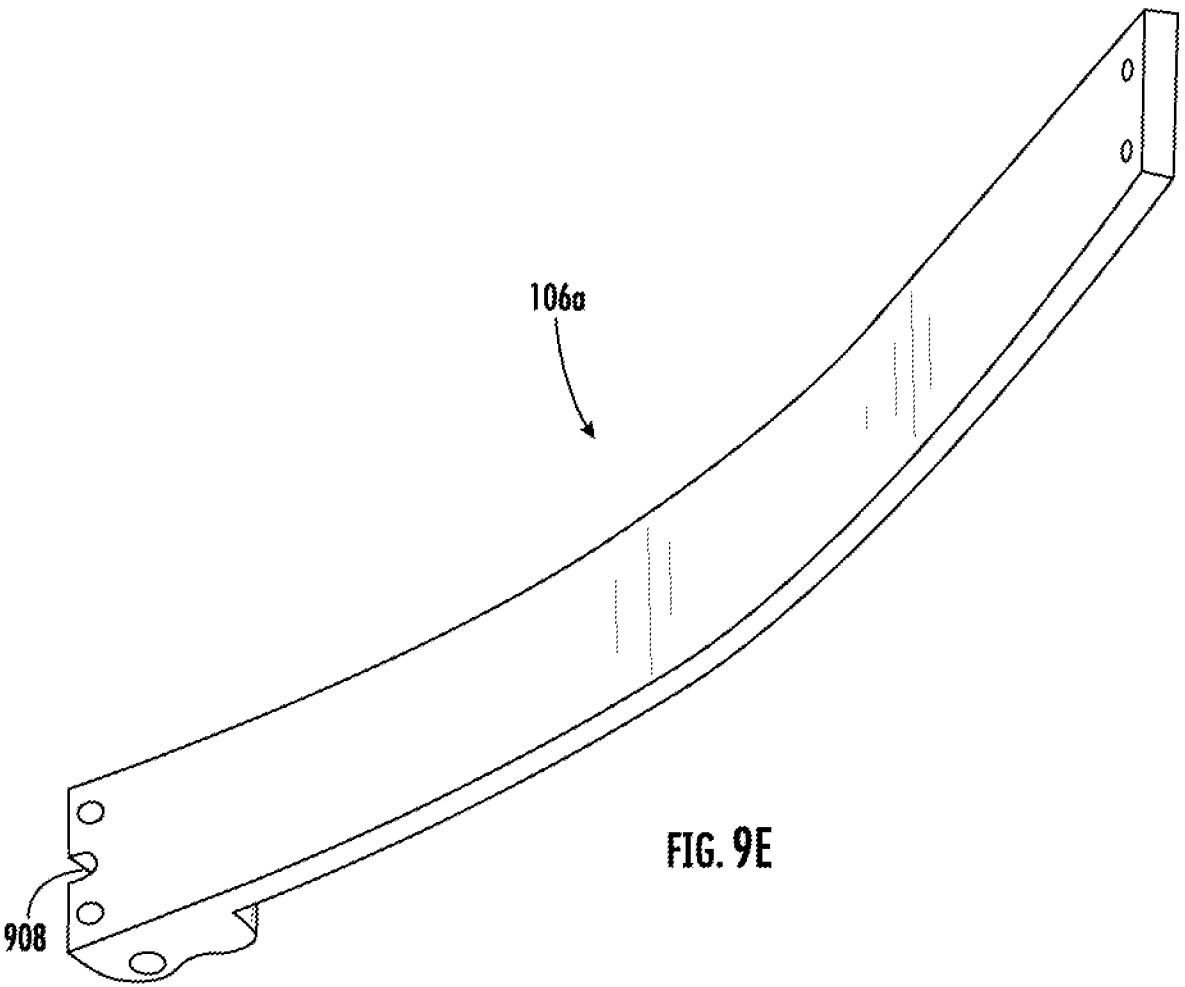
FIG. 9E is bottom side perspective view of the limb shown in FIG. 9A.
Figure 10A:
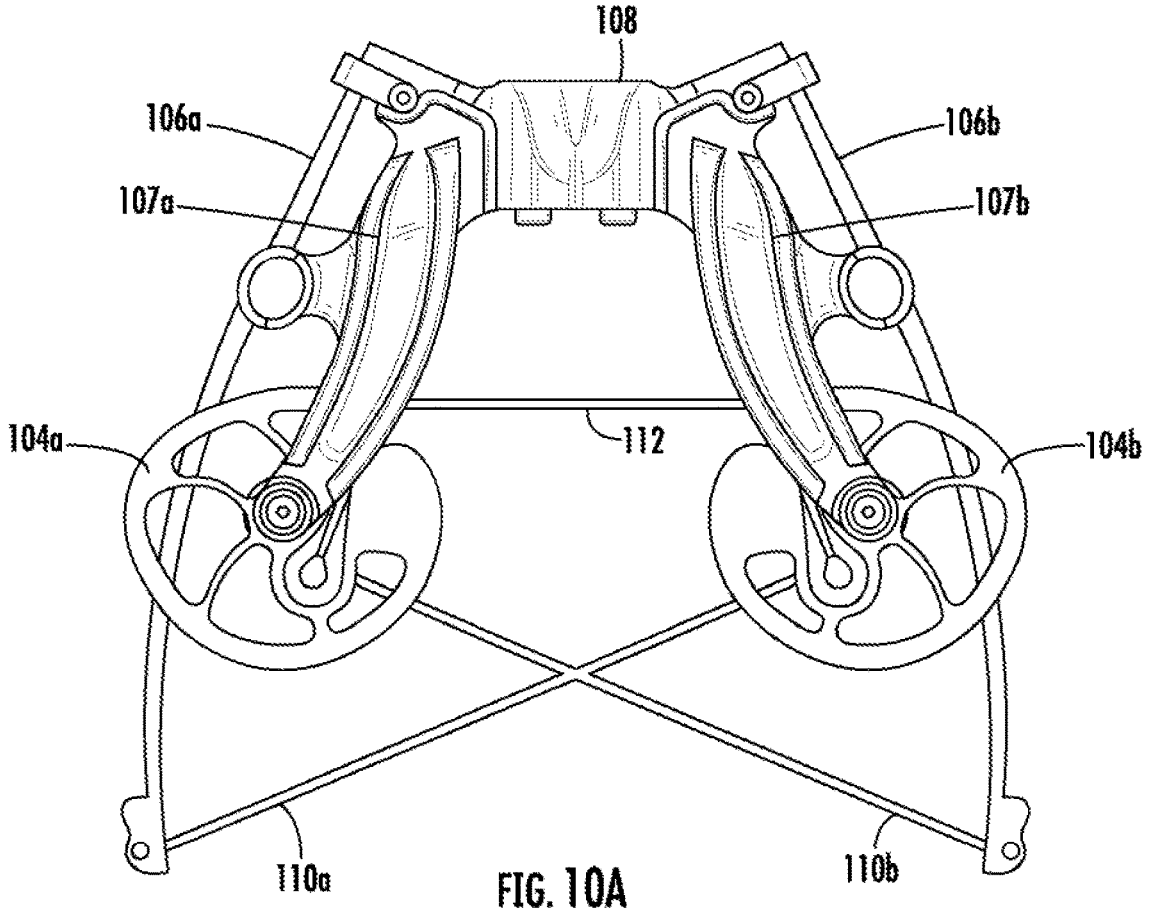
FIG. 10A is a top view of the bow assembly of the crossbow with crossing cable system showing the bow string in a full draw position.
Figure 10B:
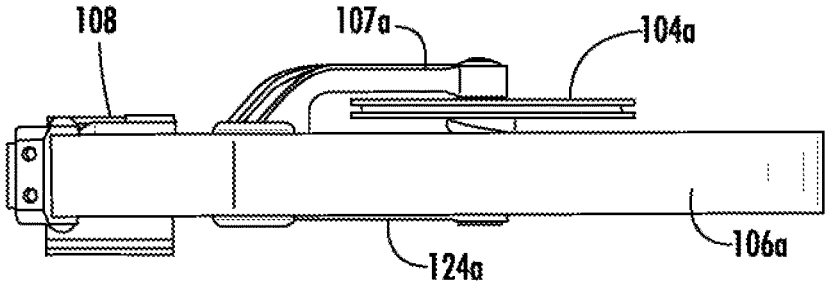
FIG. 10 B is a side view of the bow assembly of the crossbow with crossing cable system with the bow limbs positioned below the cam assemblies.
FIG. 10C. is a rear view of the bow assembly shown in FIG. 10B.
Figure 10C:
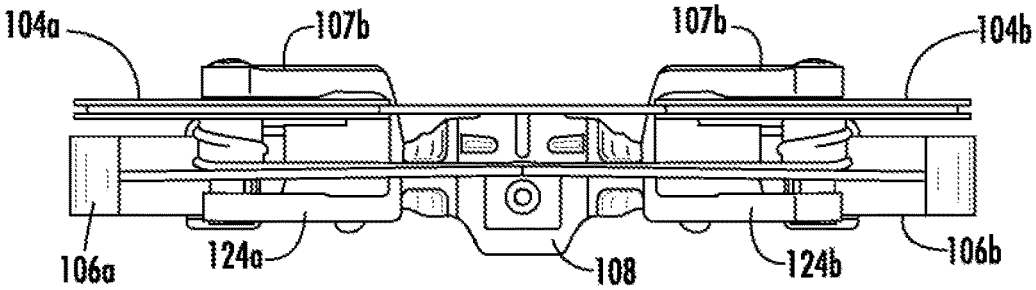
Figure 11A:
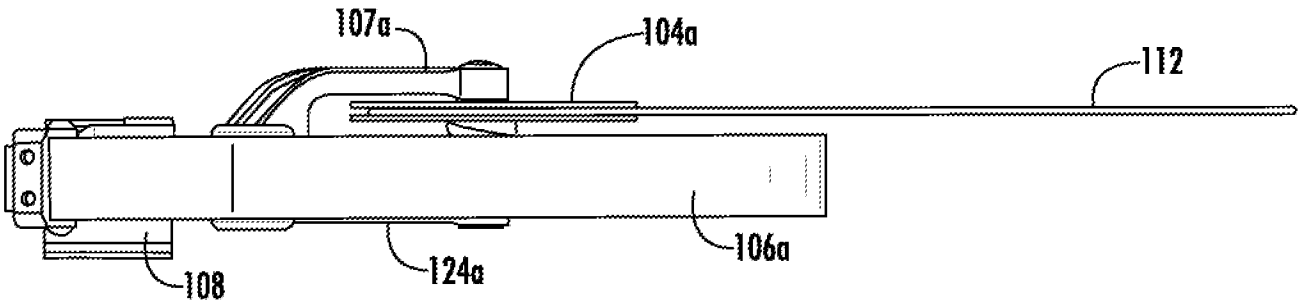
FIG. 11A is a side view of an embodiment of the bow assembly of the crossbow with crossing cable system with bow limbs positioned below the cam assemblies and the bowstring in the full draw position.
Figure 11B:
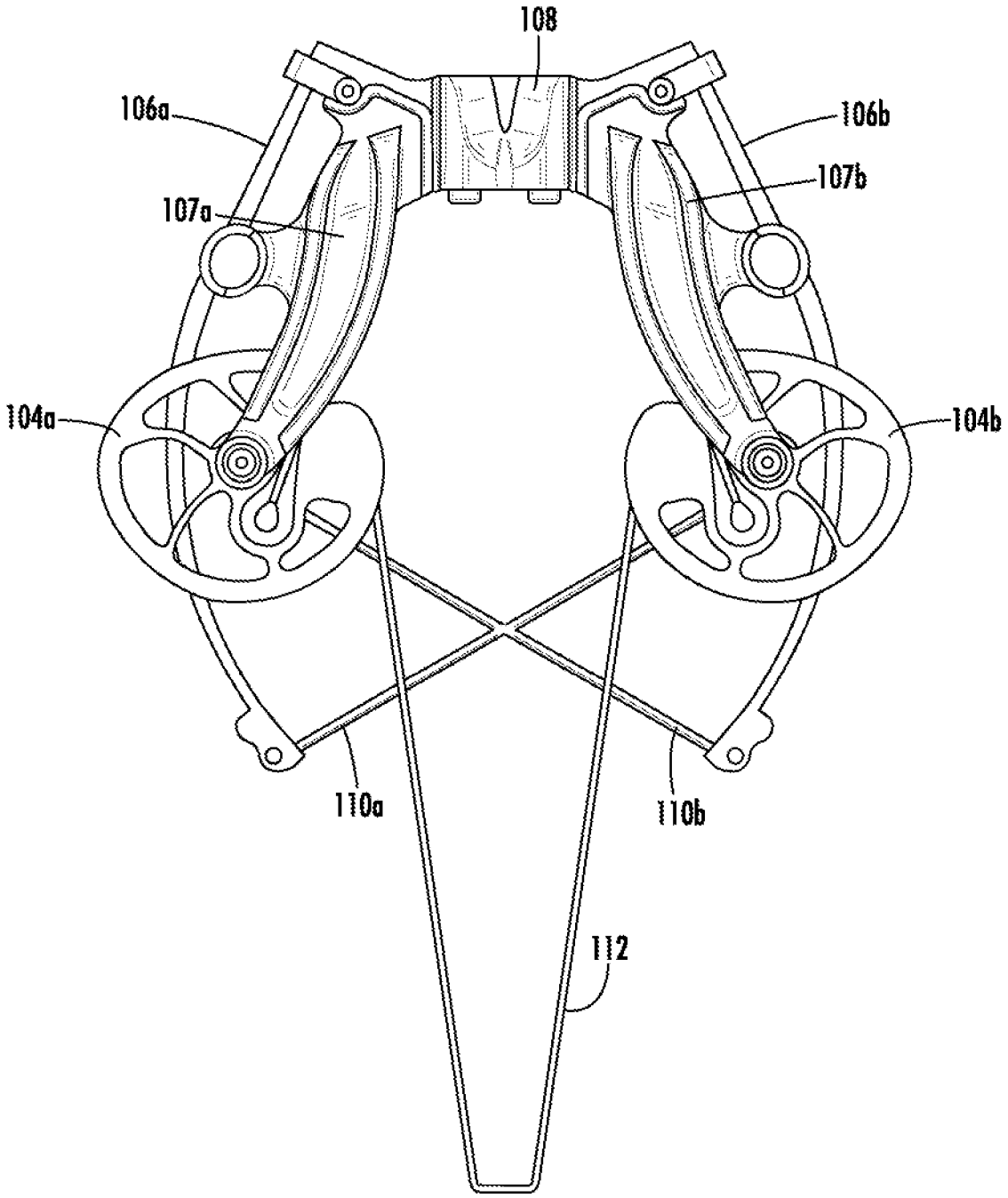
FIG. 11B is a top view of the bow assembly shown in FIG. 11A.
Figure 12A:
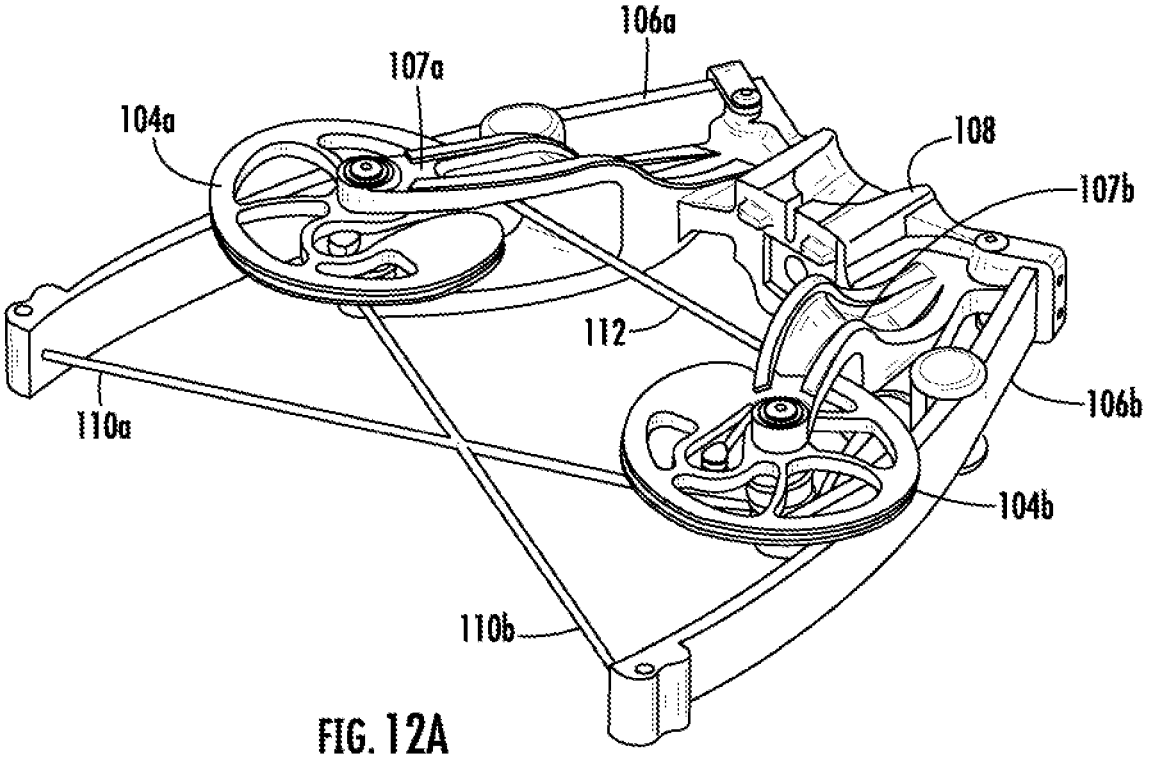
FIG. 12A is a perspective view of an embodiment of the bow assembly of the crossbow with crossing cable system with the bow string in the uncocked or brace position.
Figure 12B:
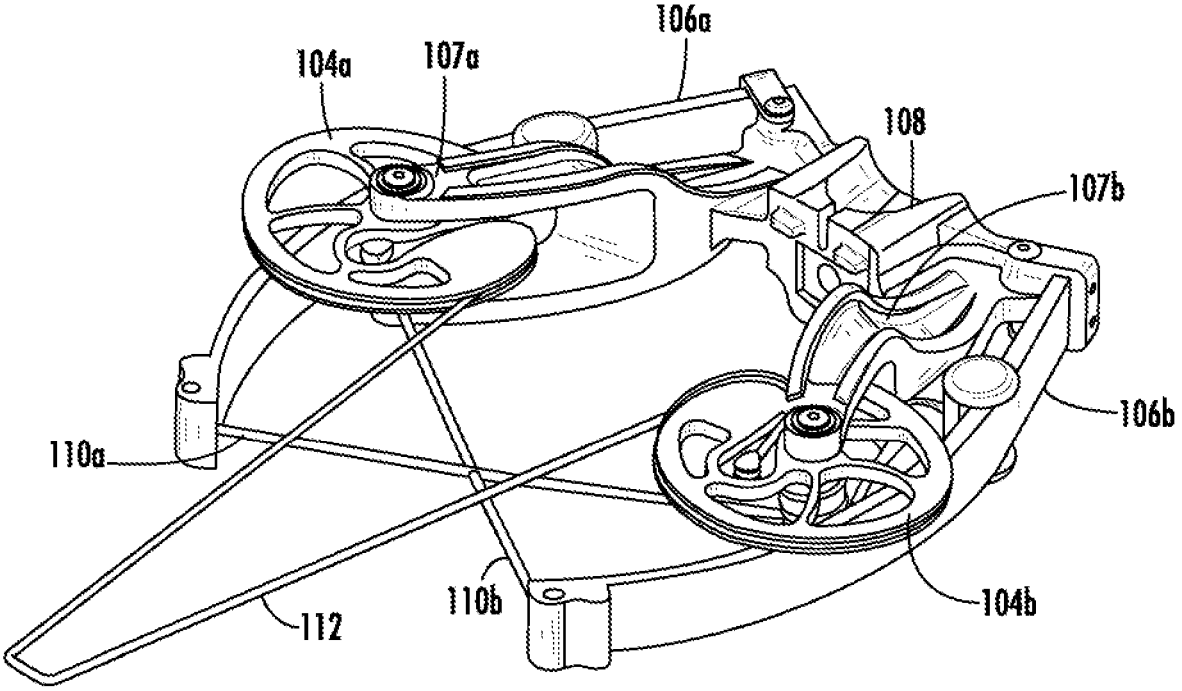
FIG. 12B is a perspective view of the bow assembly of FIG. 12B but with the bow string in the cocked or full drawn position.

Timing power cables 110*a*, 110*b* may respectively attach to cams 104*b*, 104*a* and to limbs 106*a*, 106*b*, providing a crossing (e.g., traversing centerline 101) of the timing power cables 110*a*, 110*b* in and through the stock 102. For example, cable 110*a* may attach to cam 104*b* and to limb 106*a*, and cable 110*b* may attach to cam 104*a* and to limb 106*b*. One end of cable 110*b* may attach to the proximal end of limb 106*b* at an attachment point 134*b*. The other end of cable 110*b* may attach to the bottom side of cam 104*a* at attachment point 170*a*. The cable 110*b* may wrap around a power cable take-up assembly 126*a* extending down in the form of a hub on the bottom side of cam 104*a* (FIG. 4). The cable 110*b* may wrap around a helical take-up journal 146*a* on the outer surface of the take-up assembly 126*a* (FIG. 5). According to some aspects, journal 146*a* may be considered to be an indentation that travels a full turn around the assembly 126*a* (e.g., 360 degrees). In some embodiments, the assemblies 126*a*, 126*b* may extend downward from the cam body and have at least a portion situated in the same horizontal plane as the limbs 106. For example, a lower-oriented take-up journal 146*a* (relative to the cam body) may be coplanar with the limb 106, such as coplanar with attachment point 134*a*. In this arrangement, when the crossbow is in a full draw position, a horizontal plane going through the attachment point 134*a* where cable 110*a* attaches to the limb 106*a* may be substantially parallel to a horizontal plane through the cam body of cam 104*a*/draw string guide 148*a*. In some embodiments, at full draw position, the angle cable 110 forms between attachment point 170 and a horizontal plane (e.g., one parallel to the ground, or one going through the cam body of cam 104/draw string guide 148) may be about 2 degrees. In some embodiments, at brace position, the angle cable 110 forms between attachment point 170 and a horizontal plane (e.g., one parallel to the ground, or one going through the cam body of cam 104/drawstring guide 148) may be about 4 degrees. In some embodiments, the cams 104 may be situated below the limbs 106. In this configuration, the assemblies 126*a*, 126*b* may extend upward from the cam body (instead of downward, as described above) and have at least a portion situated in the same horizontal plane as the limbs 106 (see FIGS. 19, 20A, 20B, 21, and 22). For example, an upper take-up journal 146*a* (relative to the cam body) may be coplanar with the limb 106, such as coplanar with attachment point 134*a*. In this arrangement, the cable angle may still be substantially parallel to a horizontal plane through the cam body of cam 104*a*/draw string guide 148*a*. Likewise, the angle cable 110 forms between attachment point 170 and a horizontal plane (e.g., one parallel to the ground, or one going through the cam body of cam 104/draw string guide 148) may be about 2 degrees (at full draw position) and about 4 degrees (at brace position). For example, a lower-oriented take-up journal 146*a* (relative to the cam body) may be coplanar with the limb 106, such as coplanar with attachment point 134*a*. In this arrangement, when the crossbow is in a full draw position, a horizontal plane going through the attachment point 134*a* where cable 110*a* attaches to the limb 106*a* may be substantially parallel to a horizontal plane through the cam body of cam 104*a*/draw string guide 148*a*.

One end of cable 110*a* may attach to the proximal end of limb 106*a* at an attachment point 134*b*. The other end of cable 110*a* may attach to the bottom side of cam 104*b* at attachment point 170*b*. The cable 110*a* may wrap around a power cable take-up assembly 126*b* extending down on the bottom side of cam 104*b*. The cable 110*a* may wrap around a helical take-up journal 146*b* on the outer surface of the take-up assembly 126*b*.

Cables 110*a*, 110*b* may cross (e.g., traverse centerline 101) through a cable stabilizer assembly 129 located within a cable crossing aperture 128 extending from the left side 120 to the right side 122 within and through the stock 102. In some embodiments, cables 110*a*, 110*b* may traverse centerline 101 inside the stock 102. In some embodiments, cables 110*a*, 110*b* may traverse centerline 101 below or above the stock 102. In some embodiments, cables 110*a*, 110*b* may cross inside the stock 102. In some embodiments, cables 110*a*, 110*b* may cross below or above the stock 102. Cable stabilizer assembly 129 may include two channels, one for each cable 110*a*, 110*b* to pass through. Aperture 128 may be located under the upper rail track 131 and above center rails 130 in a central stock opening 132 of the stock 102. The cables 110*a*, 110*b* are non-coplanar with the draw string 112. The crossing of the cables 110 acts to minimize the offset loads and deflection of the cables 110 crossing the centerline 101 of the track 131.

Because a user might not pull an arrow directly in the center of the flight track each and every time, and because the limbs of a crossbow might not be perfectly matched, the accuracy of a shot arrow may decrease, as in conventional systems. The present embodiments address this with the crossing closed loop system presently disclosed. That is, the fixing of the cams 104 on the mounting brackets 107 and 124 prevents getting feedback from the opposing limb and keeps the crossbow and cables in time.

FIGS. 5A-5E illustrate a cam assembly 104 (104*a*, as shown) in accordance with disclosed aspects. Applicant notes that while reference to one of the opposing/opposite components may be described (e.g., discussing cam 104*a* and not 104*b*), operation and description of the described component may be applied to the other opposing/opposite component (which may be equal, opposite, and/or reverse). Cam assembly 104 may include a top side 501 and a bottom side 508. Cam assembly 104 may include a plurality of apertures 502 spaced around the cam 104 with varying shapes. The cam 104 may include a cam-draw string attachment point 150 and a draw string guide 148*a* located on the outer perimeter of the main cam body of the cam 104. The draw string 112 may fit in the guide 148*a*, wrap around the cam 104*a*, and attach at the attachment point 150, fitting through an internal string guide 504 having a channel 172 extending from the outer edge of the cam 104 inward to the attachment point 150. According to some aspects, the string guide 148*a* may be in substantially the same horizontal plane as the flight track of the crossbow 100.

Cam 104 may also include a borehole 506*a* that forms an axle 139*a* when attached to the mounting brackets 107 and 124 via a bolt or other attachment means through 506*a*. Cam 104 may rotate around the axle 139*a* via movement or drawing of the draw string 112. On the bottom side 508 of the cam 104, the power cable take-up assembly 126 extends from the center of main body portion of the cam 104 down away from the main body portion of the cam 104. Take-up assembly 126 may include one or more helical journals 146 that wrap around the outer surface of the assembly 126, forming a helical pattern.

Figure 18:
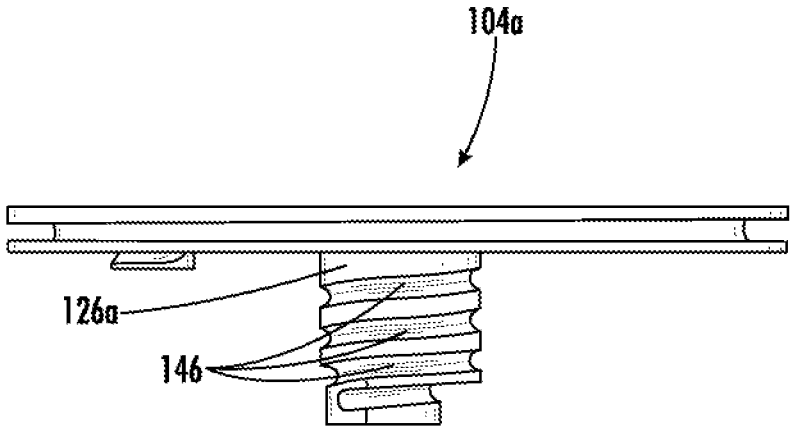
FIG. 18 is a side view of an embodiment of a cam of the crossbow with crossing cable system.
Figure 19:
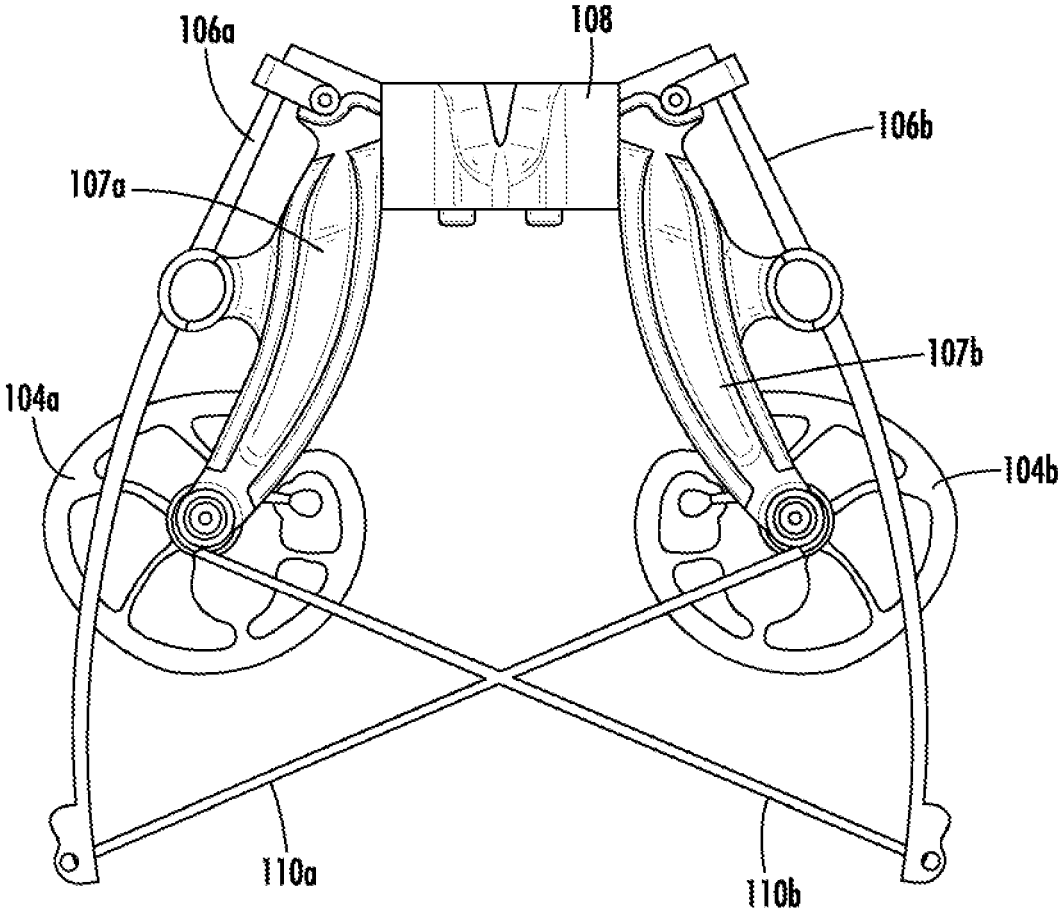
FIG. 19 is a top view of an embodiment of a bow assembly of the crossbow with crossing cable system with the bow limbs positioned above the cam assemblies.
Figure 20A:
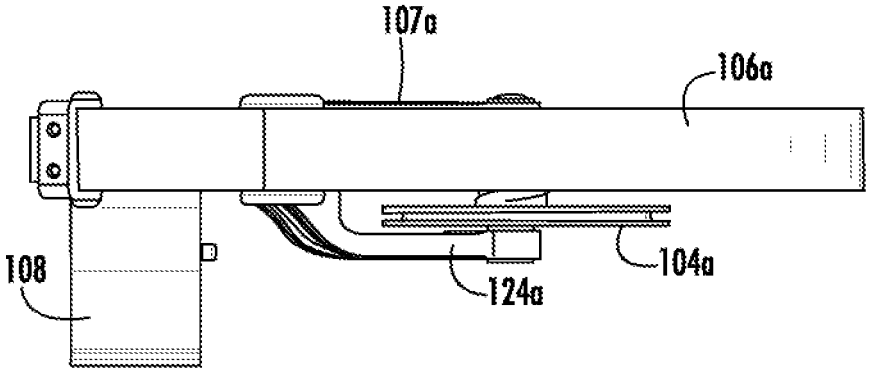
FIG. 20A is a side view of the bow assembly shown in FIG. 19.
Figure 20B:
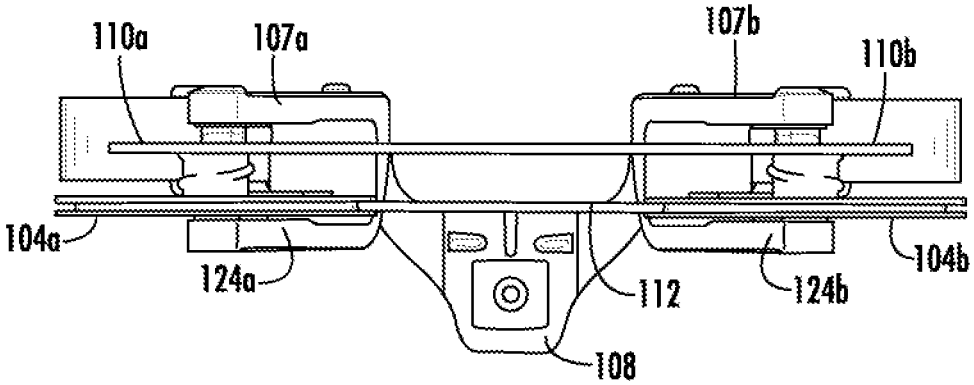
FIG. 20B is a rear view of the bow assembly shown in FIG. 19.
Figure 21:
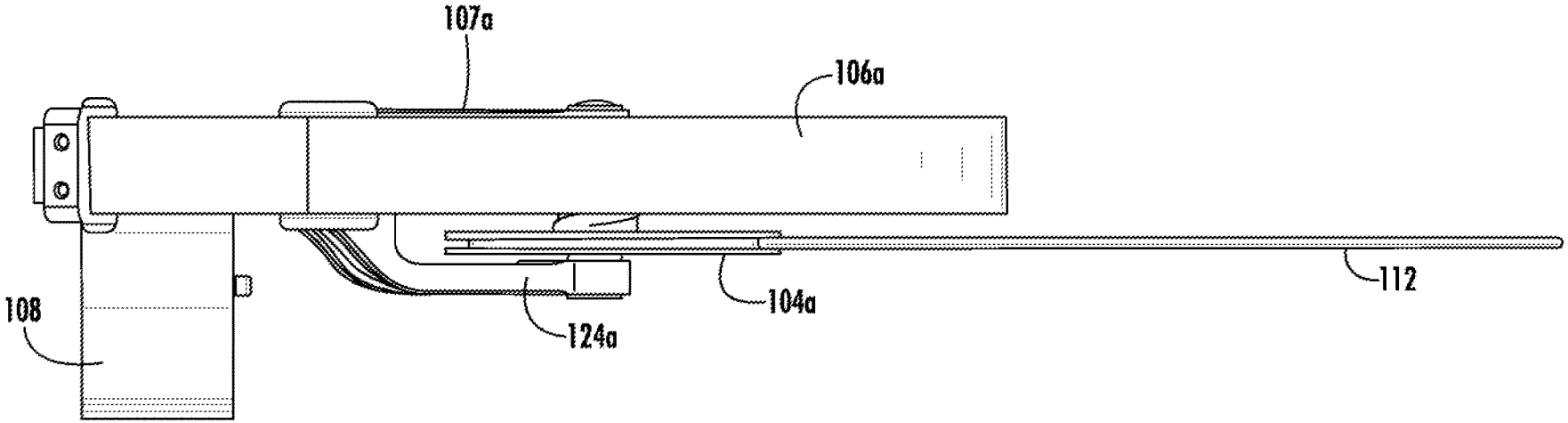
FIG. 21 is a side view of the bow assembly shown of the crossbow with crossing cable system with the bow limbs positioned above the cam assemblies and the bowstring in the cocked or full draw position.
Figure 22:
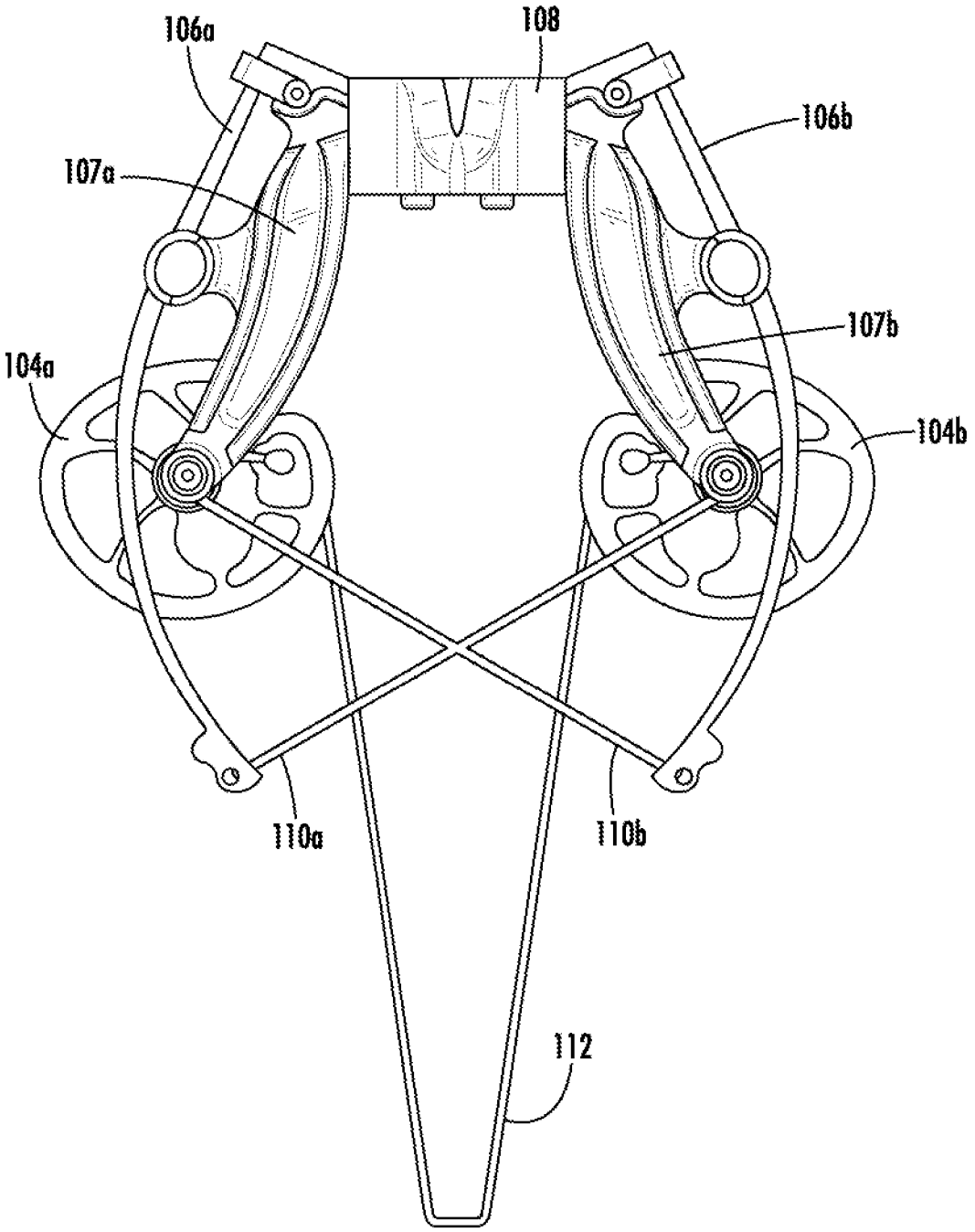
FIG. 22 is a top view of the bow assembly shown in FIG. 21.

The bottom side 508 may include attachment point 170*a*. Power cable 110*b* may wrap around the helical journals 146 and attach at the attachment point 170*a*. As shown, there may be three helical journals 146, such that power cable 110*b* may wrap around about three full turns or about 1080 degrees when the draw string 112 is fully drawn. For example, the cams 104 may rotate up to about three full turns or about 1080 degrees as the drawstring 112 rotates the cams 104, thereby wrapping the power cables 110 around the assembly 126, and reverse for when the draw string 112 is released or not drawn (e.g., after firing the crossbow 100). According to some aspects, the length of the string 112 may limit the number of rotations the power cables 110 rotate around the journals 146 in the assembly 126. That is, the rotation is dictated by the length of string 112 wrapped around the string guide 148. Once the string 112 is in full draw position, no more of string 112 can be unwrapped from string guide 148, thus preventing the cam 104 and assembly 126 from rotating any further past this full draw position. In some embodiments, there may be more than three journals 146 or less than three journals 146, such as shown in FIG. 18.

As the cam 104*a* rotates when the crossbow 100 is drawn and cocked, the slack of the power cable 110*b* is taken up in the journals 146. For example, when the crossbow 100 is not cocked and the draw string 112 has yet to be drawn back toward the proximal end 118, the cable 110*b* may occupy the top two journals 146. In one example, as the crossbow 100 is cocked and the draw string 112 is pulled back toward the proximal end 118, the cam 104*a* rotates 360 degrees and facilitates the movement of cable 110*b* down the assembly 126 such that the cable 110 occupies all three journals 146. In such an example, each 360 degree turn of the cam 104*a* may rotate the cable 110*a* down or up one journal 146. The cam profile and size may correspond to the number of journals 146 and to the vertical distance between journals 146 on the assembly 126. In some embodiments, the cam 104*a* may rotate more than 340 degrees, such as when the cam profile is smaller. In some cases, the journals 146 may be vertically spaced closer together on the assembly 126, which may be referred to as a "tight helical" cable journal configuration, such as shown in FIG. 18. In some embodiments, the cam 104*a* may rotate less than 340 degrees or even less than 270 degrees, such as when the cam profile is greater. For example, cam assemblies 104*a*, 104*b* may rotate about 259 degrees when the crossbow 100/string 112 is transitioning from a brace or non-drawn position to a fully drawn position (see FIGS. 13A and 13B). In some cases, the journals 146 may be vertically spaced farther apart on the assembly 126 in a "stretch helical" cable journal configuration, such as shown in FIG. 18.

In one embodiment of the assembly 126 having three journals, the upper journal 146 may be about ½ to ⅝ inches down from the circular body portion of the cam 104*a*. In one embodiment, the middle journal 146 may be about ⅝ to ¾ inches down from the circular body portion of the cam 104*a*. In one embodiment, the lower journal 148 may be about ¾ inches to 1 inch down from the circular body portion of the cam 104*a*. In this sense, when the crossbow 100 is at full draw, there may be a vertical distance of about ⅝ to about ¾ inches (or even 1 inch) between the draw string 112 and cable 104 on the lower journal 146, and the cable 104 may align in the same plane with the limb 106, such as aligning in substantially the same plane (e.g., horizontal plane) as connection point 134.

As the cables 104 moves up and down on the assembly 126, the angle of the cables 104 relative to a horizontal plane increases and decreases. For example, this angle may be in the range of about 0-2 degrees (e.g., at full draw) with a horizontal plane (e.g., one parallel to the ground, or one going through the cam body of cam 104/draw string guide 148) to about 4-6 degrees when the crossbow 100 is in a non-cocked configuration.

FIGS. 6A-6E illustrate upper mounting bracket 107 (107*a*) in accordance with disclosed aspects. Mounting bracket 107 may include a plurality of boreholes 601 located on the distal end 606 of the bracket 107. Boreholes 601 may be used for mounting the bracket 107 to the riser 108. Bracket 107 may include a plurality of apertures 603 and 605 that may be used for mounting or other purposes. Bracket 107 may also include a large central aperture 603. Bracket 107 may include a borehole 602 located on the proximal end 608 of the bracket 107, which may be used for mounting to cam 104*a*. The mounting brackets 107 may include a sloped portion 604, such that the proximal end 608 of the mounting brackets 107 is non-coplanar with the distal end 606 of the brackets 107.

FIGS. 7A-7I illustrate riser 108 in accordance with disclosed aspects. Riser 108 may include a left side 701, right side 703, distal end 702, and a proximal end 704. Riser 108 may include upper arc indentions 706*a*, 706*b* and lower arc indentions 707*a*, 707*b* respectively on the left side 701 and on the right side 703. The arc indentions 706, 707 may be formed on extended arms of the riser 108 that extend out away from the center of the riser 108. Caps 152 and 154 (FIGS. 1 and 2) may fit inside respective upper arc indentions 706*a*, 706*b* and lower arc indentions 707*a*, 707*b* on the left and right sides of the riser 108. Riser 108 may include apertures 708, boreholes 710, and boreholes 712. Boreholes 710 may be used for mounting the riser 108 to the proximal ends of brackets 107 and 124. Boreholes 712 may be used for mounting the riser 108 to the proximal ends of the limbs 106.

Riser 108 may include a cavity 714 and groove 716, which may facilitate the drawing and firing of an arrow or bolt placed within the groove 716. Riser 108 may attach to the stock 102 via the connection projections 713 and connection cutout 715, such as via bolts, screens, or other fastening means. The connection cutout 715 may include a borehole 718 for connecting to stock 102. Projection 713 and cutout 715 may be reciprocally shaped as the distal end of the stock 102, such that projections 713 may fit inside of the distal end of the stock 102 and an extension from the stock 102 may fit into the connection cutout 715.

FIGS. 8A-8E illustrate the lower mounting bracket 124 (124*a*) in accordance with disclosed aspects. Lower mounting bracket 124 may have a substantially flat profile (i.e., relative to the non-coplanar profile of the upper mounting bracket 107). Mounting bracket 124 may include a plurality of boreholes 801 located on the distal end 806 of the bracket 124. Boreholes 801 may be used for mounting the bracket 124 to the riser 108. Bracket 124 may include a plurality of apertures 803 that may be used for mounting or other purposes. Bracket 124 may also include a large central aperture 803. Bracket 124 may include a borehole 802 located on the proximal end 808 of the bracket 124, which may be used for mounting to cam 104*a*.

FIGS. 9A-9E illustrate a limb 106 (106*a*) in accordance with disclosed aspects. Limb 106 may include an outer side 906 and an inner side 910 and may have a bend along the elongated body of the limb 106 from the distal end 902 to the proximal end 904. The distal end 902 may include one or more apertures at attachment point 136*a* for attaching to the riser 108. The proximal end 904 may include one or more apertures and a cable groove 908 for attaching to the end of the power cable 110 (110*b*) at attachment point 134*a*.

While preferred embodiments of the present disclosure have been described, it is to be understood that the embodiments described are illustrative only and that the scope of the invention is to be defined solely by the appended claims when accorded a full range of equivalents, many variations and modifications naturally occurring to those skilled in the art from a perusal hereof

What is claimed is:

1. A crossbow, comprising:

a stock;

a riser mounted to the stock;

a left upper mounting bracket having a distal end attached to a left upper side of the riser;

a right upper mounting bracket having a distal end attached to a right upper side of the riser;

a left lower mounting bracket having a distal end attached to a left lower side of the riser;

a right lower mounting bracket having a distal end attached to a right lower side of the riser;

a left rotatable cam assembly mounted to proximal ends of the left upper and left lower mounting brackets, the left cam assembly having a left cam body and a left helical take-up journal assembly;

a right rotatable cam assembly mounted to proximal ends of the right upper and left lower mounting brackets, the right cam assembly having a right cam body and a right helical take-up journal assembly;

a left limb attached to a distal end of the left upper and lower sides of the riser;

a right limb attached to a distal end of the right upper and lower sides of the riser;

a draw string wrapped around outer surfaces of the left and right cam assemblies with a left end of the draw string attached to the left cam assembly and a right end of the draw string attached to the right cam assembly, wherein the draw string extends between the left and right cam assemblies over the stock;

a first power cable wrapped around the right helical take-up journal assembly, a first end of the first power cable connected to the right cam assembly and a second end of the first power cable connected to a distal end of the left limb at a first connection point; and a second power cable wrapped around the left helical take-up journal assembly, a first end of the second power cable connected to the left cam assembly and a second end of the second power cable connected to a distal end of the right limb at a second connection point, wherein the first and second power cables extend across a centerline of the stock, wherein the left cam body and the right cam body are vertically separated from the left and right limbs, wherein a horizontal plane of the first connection point is substantially parallel to a horizontal plane of the left cam body, and wherein a horizontal plane of the second connection point is substantially parallel to a horizontal plane of the right cam body.

2. The crossbow of claim 1, wherein the left and right cams are less than 270 degree rotatable or greater than 340 degree rotatable.

3. The crossbow of claim 1, wherein the left and right cam bodies are located vertically higher than the left and right limbs, wherein the left helical take-up journal extends below the left cam body, and wherein the right helical take-up journal extends below the right cam body.

4. The crossbow of claim 1, wherein the draw string and the left and right cam bodies are located in a same horizontal plane.

5. The crossbow of claim 1, wherein the left and right cams rotate responsive to drawing the draw string back from a distal end of the stock toward a proximal end of the stock.

6. The crossbow of claim 5, wherein the first and second cables further wrap around the left and right helical take-up journals responsive to the rotation of the left and right cams.

7. The crossbow of claim 6, wherein the left and right helical take-up journals include a left and right set of a plurality of helical take-up journals located on respective outer surfaces of the left and right helical take-up journal assemblies.

8. The crossbow of claim 7, wherein each of the left and right sets includes three vertically-separated helical take-up journals.

9. The crossbow of claim 8, wherein the first and second cables are configured to fit and move within a respective set of the helical take-up journals responsive to the rotation of the left and right cams.

10. The crossbow of claim 8, wherein a vertical distance between the left and right cam bodies and a respective helical take-up journal is in the range of about ⅝ inch to about one inch.

11. The crossbow of claim 8, wherein a vertical distance between the left and right cam bodies and a respective helical take-up journal is in the range of about ⅝ inch to about ¾ inch.

12. The crossbow of claim 8, wherein a vertical distance between the left and right cam bodies and a respective helical take-up journal is in the range of about ¾ inch to about one inch.

13. The crossbow of claim 8, wherein a vertical distance between the left and right cam bodies and a respective helical take-up journal is in the range of about ½ inch to about ¾ inch.

14. The crossbow of claim 8, wherein a vertical distance between the left and right cam bodies and a respective helical take-up journal is in the range of about ½ inch to about ⅝ inch.

15. The crossbow of claim 1, wherein a distal end of the left upper mounting bracket is located in a vertically lower plane than a proximal end of the left upper mounting bracket, and a distal end of the right upper mounting bracket is located in a vertically lower plane than a proximal end of the right upper mounting bracket.

16. The crossbow of claim 1, wherein the first and second cables cross through a cable stabilizer assembly located within a cable crossing aperture within the stock.

17. The crossbow of claim 1, wherein the first and second power cables cross the centerline inside of the stock.

18. The crossbow of claim 1, wherein the first and second power cables cross the centerline below the stock.

19. The crossbow of claim 1, wherein the first and second power cables cross the centerline above the stock.

20. The crossbow of claim 1, wherein the first and second power cables cross inside of the stock.

21. The crossbow of claim 1, wherein the first and second power cables cross below the stock.

22. The crossbow of claim 1, wherein the first and second power cables cross above the stock.

23. The crossbow of claim 1, wherein the first and second power cables do not cross.

24. The crossbow of claim 1, wherein the left cam body and the left helical take-up journal assembly are integrally formed, and the right cam body and the right helical take-up journal assembly are integrally formed.

25. The crossbow of claim 1, wherein the left and right cam bodies are located vertically lower than the left and right limbs, wherein the left helical take-up journal extends above the left cam body, and wherein the right helical take-up journal extends above the right cam body.

26. The crossbow of claim 1, wherein the draw string crosses the centerline between more distal portions of the respective cam bodies.

27. The crossbow of claim 1, wherein the draw string crosses the centerline between more proximal portions of the respective cam bodies.

28. The crossbow of claim 1, wherein the riser, the left upper, right upper, left lower, and right lower mounting brackets are integrally formed.

29. A crossbow, comprising:

a stock;

a riser mounted to the stock;

a left upper mounting bracket having a first end attached to a left upper side of the stock;

a right upper mounting bracket having a first end attached to a right upper side of the stock;

a left lower mounting bracket having a first end attached to a left lower side of the stock;

a right lower mounting bracket having a first end attached to a right lower side of the stock;

a left rotatable cam assembly mounted to second ends of the left upper and left lower mounting brackets, the left cam assembly having a left cam body and a left helical take-up journal assembly;

a right rotatable cam assembly mounted to second ends of the right upper and left lower mounting brackets, the right cam assembly having a right cam body and a right helical take-up journal assembly;

a left limb attached to the left upper and lower sides of the riser;

a right limb attached to the right upper and lower sides of the riser;

a draw string wrapped around outer surfaces of the left and right cam assemblies and attached to the left and right cam assemblies, wherein the draw string extends between the left and right cam assemblies over the stock;

a first power cable wrapped around the right helical take-up journal assembly, a first end of the first power cable connected to the right cam assembly and a second end of the first power cable connected to a distal end of the left limb at a first connection point; and a second power cable wrapped around the left helical take-up journal assembly, a first end of the second power cable connected to the left cam assembly and a second end of the second power cable connected to a distal end of the right limb at a second connection point, wherein the first and second power cables extend across a centerline of the stock, wherein the left cam body and the right cam body are vertically separated from the left and right limbs, wherein a horizontal plane of the first connection point is substantially parallel to a horizontal plane of the left cam body, and wherein a horizontal plane of the second connection point is substantially parallel to a horizontal plane of the right cam body.

30. The crossbow of claim 29, wherein the stock, the left upper, right upper, left lower, and right lower mounting brackets are integrally formed.

31. A crossbow, comprising:

a stock;

a riser mounted to the stock;

a left upper mounting bracket having a distal end attached to a left upper side of the riser;

a right upper mounting bracket having a distal end attached to a right upper side of the riser;

a left lower mounting bracket having a distal end attached to a left lower side of the riser;

a right lower mounting bracket having a distal end attached to a right lower side of the riser;

a left rotatable cam assembly mounted to proximal ends of the left upper and left lower mounting brackets, the left cam assembly having a left cam body and a left helical take-up journal assembly;

a right rotatable cam assembly mounted to proximal ends of the right upper and left lower mounting brackets, the right cam assembly having a right cam body and a right helical take-up journal assembly;

a left limb attached to a distal end of the left upper and lower sides of the riser;

a right limb attached to a distal end of the right upper and lower sides of the riser;

a draw string wrapped around outer surfaces of the left and right cam assemblies and attached to the left and right cam assemblies, wherein the draw string extends between the left and right cam assemblies over the stock;

a first power cable wrapped around the right helical take-up journal assembly, a first end of the first power cable connected to the right cam assembly and a second end of the first power cable connected to a distal end of the left limb at a first connection point; and a second power cable wrapped around the left helical take-up journal assembly, a first end of the second power cable connected to the left cam assembly and a second end of the second power cable connected to a distal end of the right limb at a second connection point, wherein the first and second power cables extend across a centerline of the stock, wherein the left cam body and the right cam body are located in a same horizontal plane as the left and right limbs.

32. The crossbow of claim 31, wherein the riser, the left upper, right upper, left lower, and right lower mounting brackets are integrally formed.

* * * * *